US007901213B1

(12) United States Patent
Beno

(10) Patent No.: US 7,901,213 B1
(45) Date of Patent: Mar. 8, 2011

(54) ERASABLE MARKER SCREEN ASSEMBLY

(75) Inventor: Steven J. Beno, Gurnee, IL (US)

(73) Assignee: ACCO Brands USA LLC, Lincolnshire, IL (US)

( * ) Notice: Subject to any disclaimer, the term of this patent is extended or adjusted under 35 U.S.C. 154(b) by 709 days.

(21) Appl. No.: 11/740,354

(22) Filed: Apr. 26, 2007

Related U.S. Application Data

(60) Provisional application No. 60/796,825, filed on May 2, 2006.

(51) Int. Cl.
*B43L 1/00* (2006.01)

(52) U.S. Cl. ..... 434/412; 434/408; 434/429

(58) Field of Classification Search ..... 434/247, 434/408, 411, 412, 413, 421, 425, 426, 429; 40/515–520; 359/461
See application file for complete search history.

(56) References Cited

U.S. PATENT DOCUMENTS

| | | | | | |
|---|---|---|---|---|---|
| 1,583,998 | A | * | 5/1926 | Richey | 40/517 |
| 1,688,677 | A | * | 10/1928 | Winter | 40/517 |
| 2,336,496 | A | * | 12/1943 | Miller | 40/516 |
| 2,726,128 | A | * | 12/1955 | Hazel, Jr. | 312/184 |
| 3,093,919 | A | | 6/1963 | Holtz | |
| 3,255,808 | A | * | 6/1966 | Schimizzi | 160/245 |
| 3,466,776 | A | * | 9/1969 | Paige | 40/517 |
| 4,157,626 | A | * | 6/1979 | Bedinghaus | 40/518 |
| 4,525,946 | A | * | 7/1985 | Olson | 40/514 |
| 4,789,443 | A | * | 12/1988 | deNora et al. | 205/513 |
| 4,996,110 | A | | 2/1991 | Tanuma et al. | |
| D317,630 | S | * | 6/1991 | Allen et al. | D20/42 |
| 5,361,164 | A | | 11/1994 | Steliga | |
| 5,417,748 | A | | 5/1995 | Kawashima | |
| 5,503,891 | A | | 4/1996 | Marshall et al. | |
| 5,573,405 | A | * | 11/1996 | Evans | 434/238 |
| 5,664,780 | A | * | 9/1997 | Bricker | 273/239 |
| 6,179,426 | B1 | | 1/2001 | Rodriguez, Jr. et al. | |
| 6,394,609 | B1 | | 5/2002 | Rodriguez, Jr. et al. | |
| 6,394,610 | B2 | | 5/2002 | Rodriguez, Jr. | |
| 6,464,507 | B1 | * | 10/2002 | Bailey | 434/247 |
| 6,476,965 | B1 | | 11/2002 | He et al. | |
| 6,485,146 | B2 | | 11/2002 | Rodriguez, Jr. | |
| 6,520,646 | B2 | | 2/2003 | Rodriguez, Jr. et al. | |
| 6,530,664 | B2 | | 3/2003 | Vanderwerf et al. | |

(Continued)

FOREIGN PATENT DOCUMENTS

WO 0143961 6/2001

(Continued)

OTHER PUBLICATIONS

Beijing Crystal Dry Erase Shade, shown at a Chinese trade fair in Apr. 2006 and believed to have been sold in Europe at least prior to Apr. 26, 2007, 3 pages.

(Continued)

*Primary Examiner* — Kurt Fernstrom
(74) *Attorney, Agent, or Firm* — Michael Best & Friedrich LLP

(57) ABSTRACT

A marker screen assembly includes a housing, a first screen stored within the housing and movable to an extended position, and a second marker screen stored within the housing and movable to an extended position. The second marker screen has a writing surface designed to be repeatably written upon and erased and is configured to overlay at least a portion of the first screen when both the first and second screens are in the extended position.

14 Claims, 27 Drawing Sheets

U.S. PATENT DOCUMENTS

| | | | | |
|---|---|---|---|---|
| 6,568,814 | B2 | 5/2003 | Rodriguez, Jr. et al. | |
| 6,604,829 | B2 | 8/2003 | Rodriguez, Jr. | |
| 6,648,051 | B1 | 11/2003 | Young | |
| 6,767,591 | B2 | 7/2004 | Meccia et al. | |
| 2005/0150423 | A1 | 7/2005 | Godbout | |
| 2005/0243416 | A1* | 11/2005 | Choi | 359/460 |
| 2007/0094904 | A1* | 5/2007 | Frank et al. | 40/594 |
| 2008/0093524 | A1* | 4/2008 | Bertrand | 248/460 |

FOREIGN PATENT DOCUMENTS

| | | |
|---|---|---|
| WO | 02086618 | 10/2002 |

OTHER PUBLICATIONS

Mediadecor, QC Moving Art Series, The HideandChic™ HCF-QC Series, http://www.mediadecor.com/Pages/QC_Series.htm, webpage visited May 9, 2007, 2 pages.

Whiteboards ETC.COM, Opti-Rite® 3 Projection Wall Covering Materials, http://www.whiteboardsetc.com/poly-rite_iii.htm, webpage visited Apr. 29, 2006, 5 pages.

Egan, A Guide to Presentation Surfaces, http://files.egan.com/pdfLib/binder/shared/024B202_r1.PresSurf.pdf, webpage visited May 9, 2007, 6 pages.

INDOFF, Surfaces for Dry Erase Boards, http://www.ahutton.com/dry-erase/surfaces-4P-User.pdf, webpage visited May 9, 2007, 4 pages.

3M, Hong Kong, Post-it® Whiteboard Sheet, http://www.3m.com/intl/hk/english/in_hongkong/postit/supersticky/prod_ss.html, webpage visited May 9, 2007, 1 page.

Aslan, Aslan Self-adhesive Whiteboard-film www.ASLAN-Schwarz.com, webpage visited May 2, 2007, 2 pages.

Avery Office Products, Austrlia, Write On Cling Sheets—930101, http://www.averyproducts.com.au/main.jsp?action=product.Product&bct=4&bcn=93010&pid=93010, webpage visited May 9, 2007, 1 page.

Magic Whiteboard, United Kingdom, Whiteboard from a roll, http://www.magicwhiteboard.com/uk/index.html, webpage visited May 9, 2007, 2 pages.

Rumkin, Make a Whiteboard, http://rumkin.com/reference.whiteboard, webpage visited May 9, 2007, 2 pages.

* cited by examiner 20
22
24
26
28
30
32
34
38
42
46
50
54

ERASABLE MARKER SCREEN ASSEMBLY

RELATED APPLICATIONS

This application claims priority to U.S. Provisional Patent Application Ser. No. 60/796,825, filed May 2, 2006, the entire contents of which are hereby incorporated by reference.

BACKGROUND

The present invention relates to erasable marker boards.

Erasable marker boards or whiteboards are often used in classrooms, offices, conference rooms, etc. Typically, the marker boards include a smooth, white surface that can be written on using a dry erase marker. The marker boards can be erased using a dry eraser.

SUMMARY

Typical marker boards are generally rigid and are fixed to a wall such that the marker board is immobile. It is desirable for a marker board to be mobile so that the user can take the marker board to a different office, classroom, conference room, etc. Furthermore, it can be desirable to selectively hide or cover the information written on the marker board. Typically marker boards have been supplied within cabinets or doors in order to cover the marker board when the user desires. However, these solutions limit the mobility of the marker board. Therefore, it is desirable to create a marker board assembly that is both mobile and able to cover or hide the information written on the marker board.

In one embodiment, the invention provides an erasable marker screen assembly that includes a marker screen, a housing, and a rolling mechanism configured to roll the marker screen within the housing.

In another embodiment, the invention provides a marker screen assembly that includes a housing, a first screen stored within the housing and movable to an extended position, and a second marker screen stored with the housing and movable to an extended position. The second marker screen has a writing surface designed to be repeatably written upon and erased and is configured to overlay at least a portion of the first screen when both the first and second screens are in the extended position.

In yet another embodiment, the invention provides a marker screen assembly that includes a first housing, a first screen stored within the first housing and movable to an extended position, and a second housing adjacent to the first screen. The marker screen assembly also includes a second marker screen stored within the second housing and movable to an extended position. The second marker screen has a writing surface designed to be repeatably written upon and erased and is configured to overlay at least a portion of the first screen when both the first and second screens are in the extended position.

In still another embodiment, the invention provides a portable marker screen assembly that includes a housing sized and configured to be carried by a user, and a coupling member connected to the housing and configured to removably couple the housing to a surface. The portable marker screen assembly also includes a marker screen stored within the housing and movable to an extended position. The marker screen has a writing surface designed to be repeatably written upon and erased.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and coupled "coupled" are not restricted to physical or mechanical connections or couplings.

DETAILED DESCRIPTION

Figure 1:
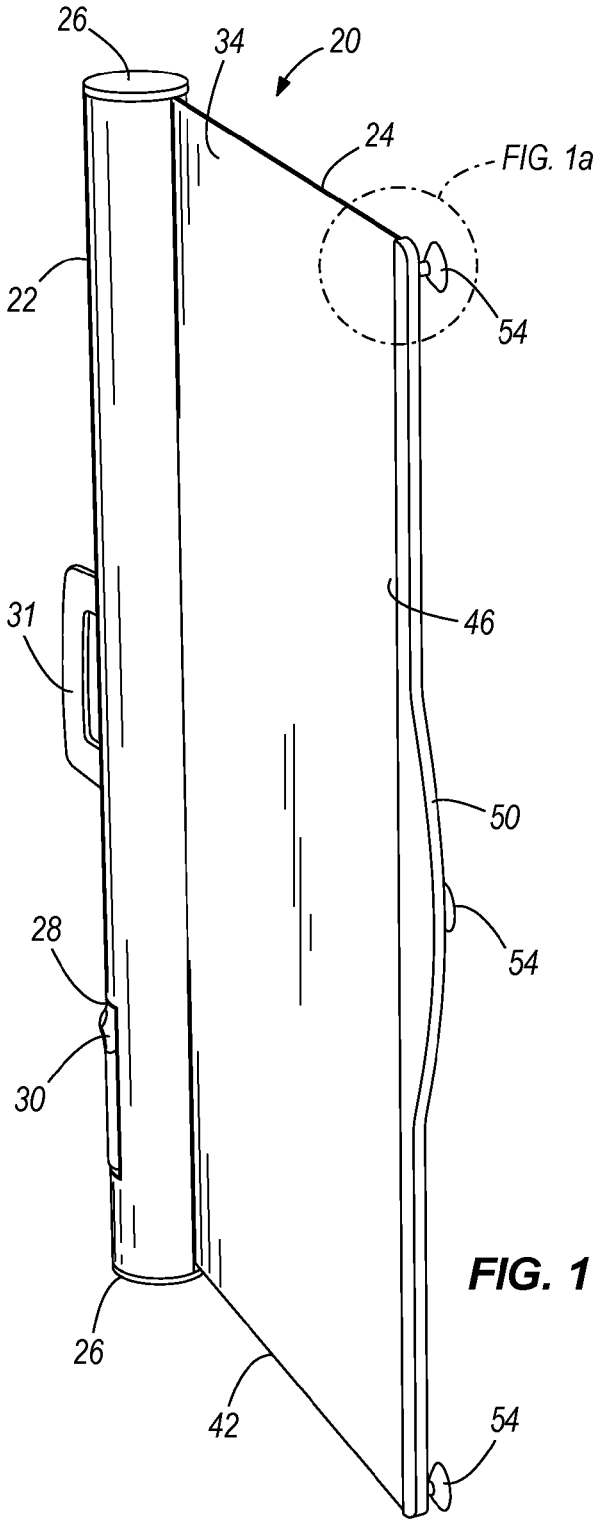
FIG. 1 is a front perspective view of an erasable marker screen assembly embodying the present invention.

FIG. 1 illustrates an erasable marker screen assembly 20 that includes a housing 22 and a retractable screen 24 that is stored within the housing 20. The illustrated housing 22 is a generally tubular member with end caps 26. In other constructions, the housing 22 can have a plurality of generally flat sides (i.e., rectangular, pentagonal, hexagonal, etc.) or may take other suitable shapes.

The illustrated housing 22 includes a recess 28 that stores or retains a marker 30 or other suitable writing instrument. In other constructions the housing 22 can include additional recesses or holders for writing instruments, erasers, pointers, other office supplies and the like. The housing 22 can also include a strap, handle 31 (shown only in FIG. 1), or other suitable carrying member that facilitates transporting the marker screen assembly 20.

Figures 2, 2A, 3, 3A, 4, 4A, 4B:
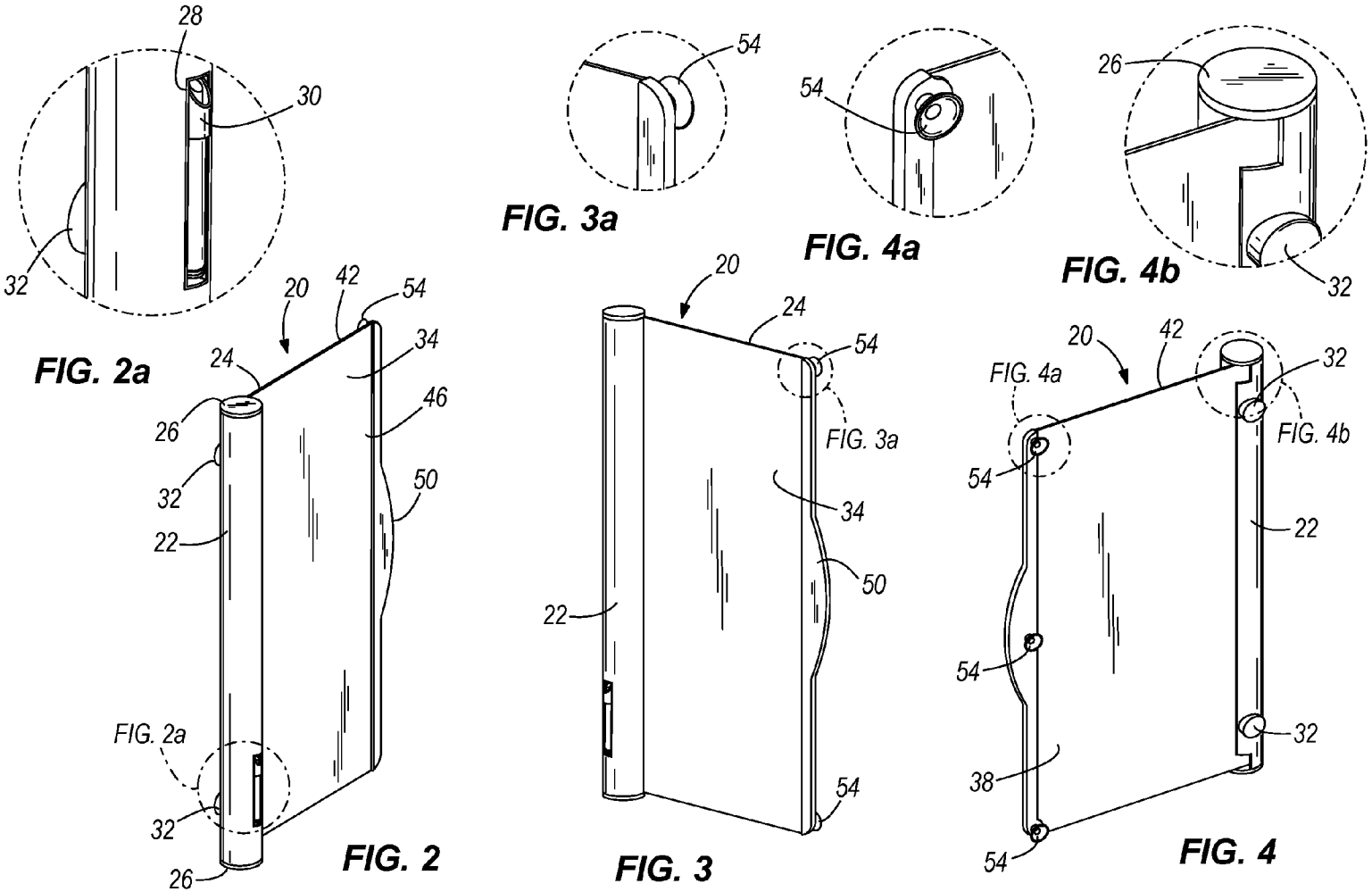
FIG. 2 is another front perspective view of the marker screen assembly of FIG. 1.
FIG. 2*a* is an enlarged portion of FIG. 2 showing an integral marker holder.
FIG. 3 is yet another front perspective view of the marker screen assembly of FIG. 1.
FIG. 3*a* is an enlarged portion of FIG. 3 showing a coupling member of the marker screen assembly.
FIG. 4 is a rear perspective view of the marker screen assembly of FIG. 1.
FIG. 4*a* is an enlarged portion of FIG. 4 showing the coupling member of the marker screen assembly.
FIG. 4*b* is an enlarged portion of FIG. 4 showing the interface between the marker screen and the housing of the marker screen assembly.
Figure 7:
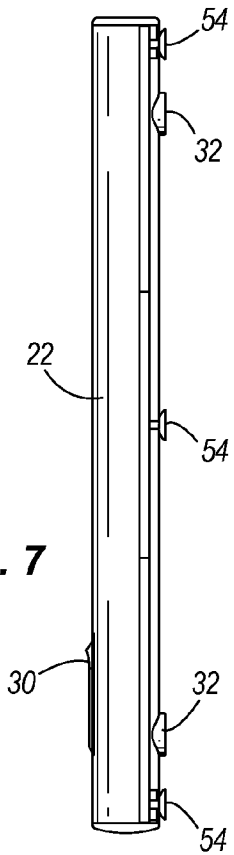
FIG. 7 is another side view of the marker screen assembly of FIG. 1.
Figure 6:
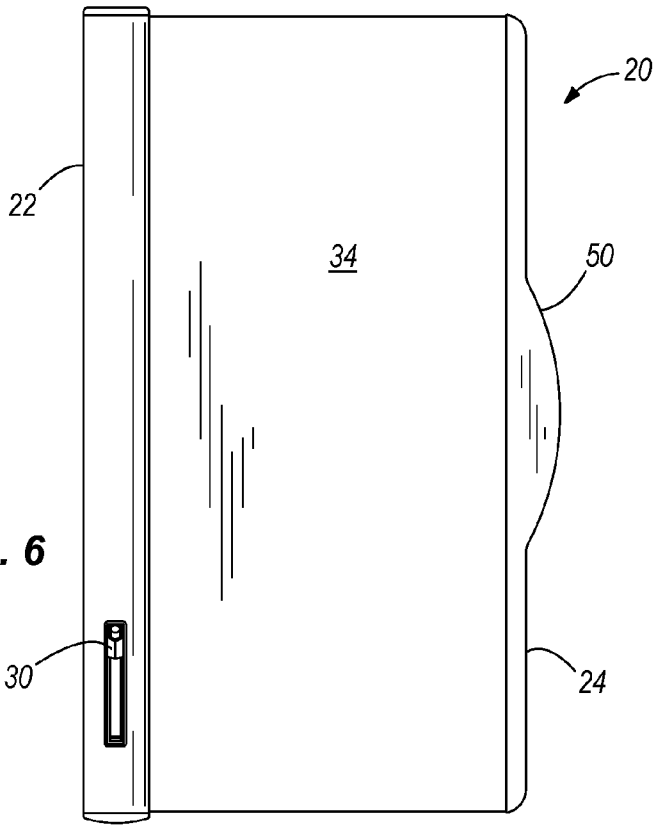
FIG. 6 is a front view of the marker screen assembly of FIG. 1.
Figure 8:
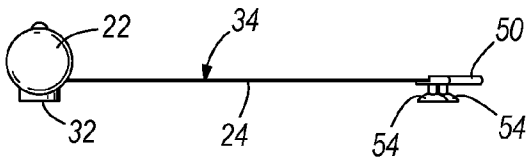
FIG. 8 is a bottom view of the marker screen assembly of FIG. 1.
Figure 5:
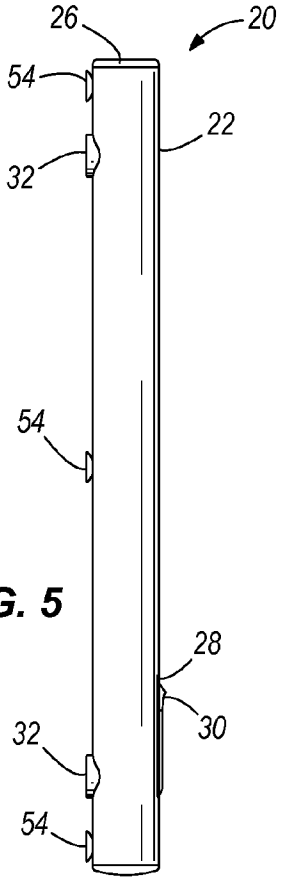
FIG. 5 is a side view of the marker screen assembly of FIG. 1.
Figure 9:
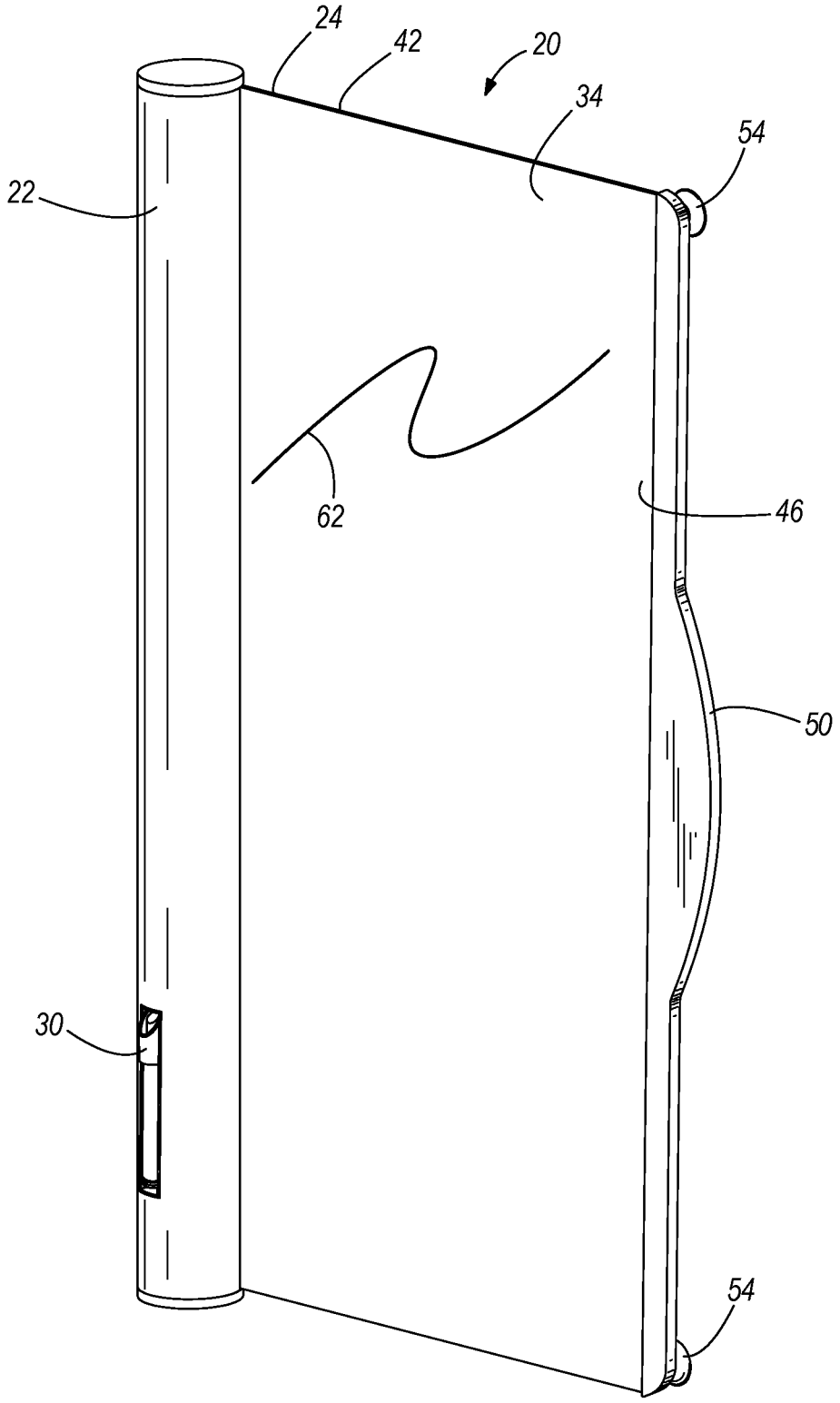
FIG. 9 is yet another front perspective view of the marker screen assembly of FIG. 1 showing the marker screen extended from the housing.
Figure 10:
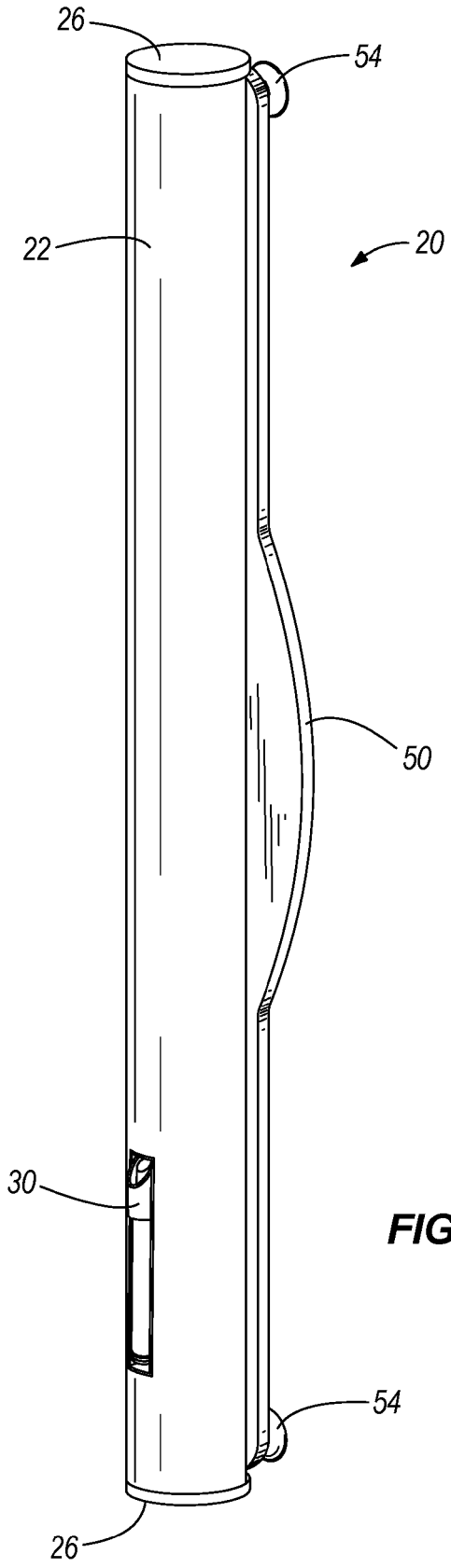
FIG. 10 is a front perspective view of the marker screen assembly of FIG. 1 showing the marker screen retracted within the housing.

Referring to FIGS. 2 and 4, the illustrated housing 22 further includes coupling members 32. The coupling members 32 can be any suitable member that couples the erasable marker screen assembly 20 to a surface such as a wall (i.e., drywall, cubical wall, glass wall, etc.), window, ceiling, chalkboard, existing dry erase board, or any other suitable surface. The coupling members 32 can include suction cups, magnets, brackets, hooks, adhesives, VELCRO, apertures, and the like. In other constructions, the coupling members 32 can be configured to couple the marker screen assembly 20 to a folding stand, easel, and the like.

Some of the coupling members 32 described above (e.g., suction cups, magnets) generally facilitate removably coupling the marker screen assembly 20 to a surface, stand, etc., such that the marker screen assembly 20 is easily portable or mobile, and do not require any permanent alteration or addition to the mounting surface (e.g., receiving brackets, nail/screw holes, etc.). In other constructions, the coupling members can be configured to more permanently mount the marker screen assembly 20 to a wall, window, within or to a ceiling, and the like.

Referring to FIGS. 3 and 4, the erasable marker screen 24 includes a writing surface 34 and a writing surface support member or backing 38. In the illustrated construction the writing surface 34 is a generally smooth and glossy surface that can be written on using the marker 30 and then erased. In other constructions, the writing surface can be a lenticular surface that can be written on and then erased. The writing surface 34 can be applied to the support member/backing 38 in any suitable manner (e.g., laminating, spray coating, other coating processes, etc.), or can be integrally formed with the support member/backing 38.

The marker 30 can be any suitable marker such as a dry erase marker, permanent marker, wet erase marker, and the like. In one construction, the marker 30 is a marker or pen that has a leuco dye or similar system, but no dry erase oils. When such a marker is used on the writing surface 34, it works and looks like a standard dry erase marker or pen. However, the marker can only be erased with a wet eraser. A standard dry eraser, dry cloth, or the user's finger will not erase the writing. Such a marker is advantageous for use with the illustrated marker screen 24 that retracts into the housing 22 because the writing from a typical dry erase marker may smudge or smear when the marker screen 24 is rolled within the housing 22 (discussed below).

It should be understood that a typical dry erase marker can be used with the erasable marker screen assembly 20 and the writing surface 24. Other constructions of the marker screen assembly 20 may include features that prevent smearing and smudging of writing created with a typical dry erase marker or pen when the marker screen is retracted within the housing 22.

The wet erase marker described above is just one possible construction of a wet erase marker and other types of wet erase markers or pens can be utilized with the writing surface 24 of the erasable marker screen assembly 20. For example, the marker or pen may include a die that is only erasable with an amine-water eraser or similar, and not a dry eraser. Such an eraser may utilize a solvent that decolorizes the marker die so that the die disappears rather than smudges. In other constructions, the marker may combine a solvent that decolorizes the marker die and alternative dry erase oils that partially polymerize the marker die on contact with air. Such a marker would provide the experience and functionality of a dry erase marker, but the ink gains permanence upon standing and the marker would not be erasable with a typical dry eraser, dry cloth, the user's finger, etc.

Referring to FIGS. 3 and 4, the illustrated writing surface 34 is formed on a flexible sheet 42 that can be rolled within the housing 22. The sheet 42 is coupled to the writing surface support member 38. The writing surface support member 38 can be any suitable member that provides rigidity to the sheet 42 and the writing surface 34 while still being able to roll within the housing 22. In one construction, the support member 38 can be an inflatable air bladder. In such constructions, the erasable marker screen assembly 20 may include a fan, blower, etc. that inflates the bladder after at least a portion of the sheet 42 has been removed from the housing 22. The user can then deflate the bladder when the user desires to roll the sheet 42 and the surface support member 38 within the housing 34.

In other constructions, the writing surface support member 38 can be formed from a plastic or thin metal material and constructed to be selectively rollable or ridged. In such constructions, the user can deflect the marker screen 24 causing the surface support member 38 to be either slightly concave or slightly convex. As viewed from the writing surface 34, when the surface support member is slightly concave it can be rolled, and when the surface support member is slightly convex it is rigid.

In yet other constructions, the writing surface support member 38 can be a generally thin sheet that is not substantially rigid or can be integral with the flexible sheet 42. In such constructions, the marker screen assembly 20 can utilize a wall, chalkboard, or any underlying surface to provide support for the writing surface 34.

Referring to FIG. 1, the erasable marker screen 24 further includes a first end portion 46 and a second end portion (not visible) that is retained within the housing 22. In the illustrated construction, a handle 50 is coupled to the first end portion 46 of the marker screen 24. The illustrated handle 50 extends along the entire width of the first end portion 46 to provide support and rigidity to the first end portion 46 of the marker screen 24, although this need not be the case in alternative embodiments. While not illustrated, the handle 50 could include an aperture to facilitate grasping and/or to help secure the screen 24 in the extended position.

Figure 1A:
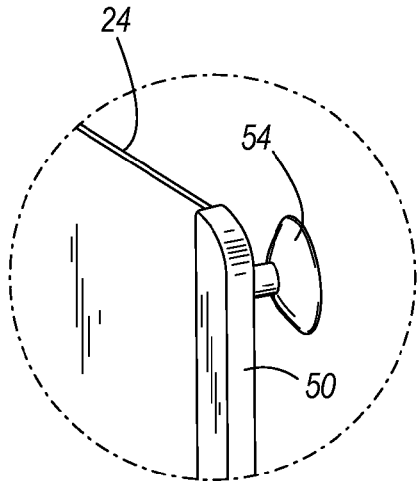
FIG. 1*a* is an enlarged view of a portion of the marker screen assembly of FIG. 1.

Referring to FIGS. 1 and 1*a*, one or more coupling members 54 are coupled to the handle 50 of the marker screen 24. The coupling members 54 can be any suitable member that couples the marker screen 24 to a surface such as a wall, window, ceiling, chalkboard, existing dry erase board, or any other suitable surface. Similar to the coupling members 32 of the housing 22 (FIG. 2), the coupling members 54 of the marker screen 24 can include suction cups, magnets, brackets, hooks, adhesives, VELCRO, apertures, and the like. In other constructions, the coupling members 54 can be configured to couple the marker screen assembly 20 to a folding stand, easel, and the like.

While not illustrated, the marker screen assembly 20 includes a rolling mechanism within the housing 22 that is operable to roll the marker screen 24 around a shaft that is also within the housing 22. These types of rolling mechanisms are known in the art and typically include a rotational spring that biases and rotates the shaft. A clutch can be incorporated to hold the marker screen 24 in extended positions or allow the user to selectively retract the marker screen 24 within the housing 22. Somewhat similar mechanisms can be found in window shades, projector screens, and the like.

Referring to FIG. 1, while the illustrated marker screen assembly 20 includes a single writing surface 34, in other constructions the marker screen assembly 20 can include multiple writing surfaces. For example, in one construction, such as the marker screen assembly of FIGS. 18-21 (discussed below), the marker screen assembly 20 includes a second marker screen that is extendable from the housing to cover all or a portion of the illustrated writing surface 34. The second marker screen can include attachment members 536 (FIG. 31*a*), such as clips, clamp, hooks, magnets apertures, and the like to couple the second screen in an extended position to the first marker screen 24 (e.g., to the handle 50 or a portion of the perimeter of the first screen 24).

Figure 27:
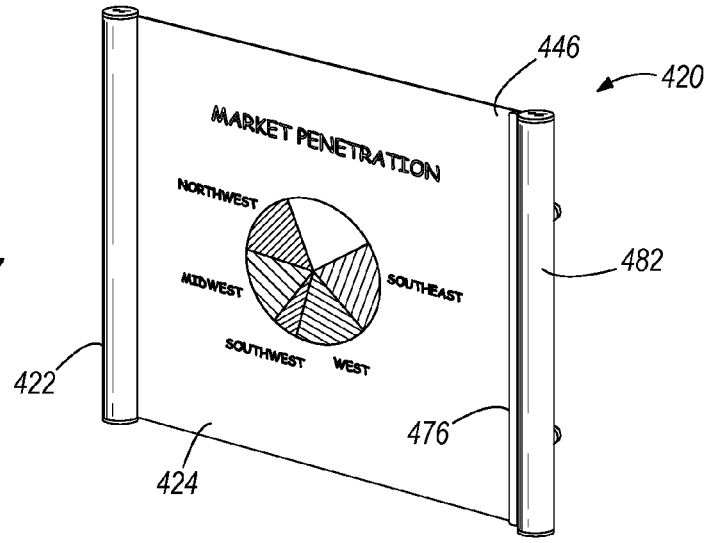
FIGS. 27-29 illustrate yet another alternative construction of a marker screen assembly.
Figure 28:
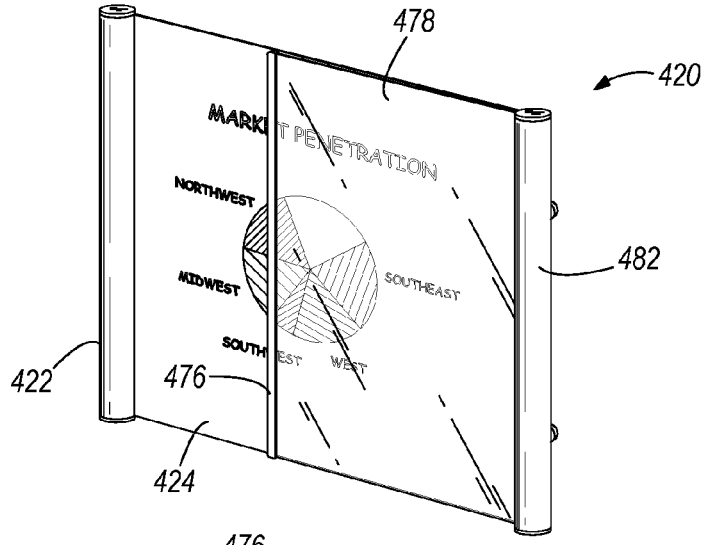
Figure 29:
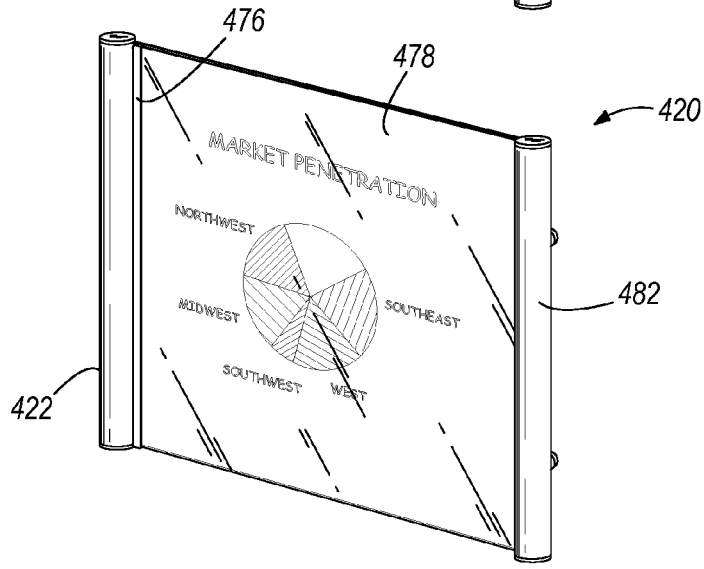

In one construction, the second screen is translucent or transparent such that the writing or images on the first screen 24 are visible through the second screen, as shown in FIGS. 27-29. The user can write on the second screen, similar to the first screen 24, to overlay writing or images on the second screen with writing or images on the first screen 24. In yet other constructions, the marker screen assembly 20 can include any suitable number of screens similar to the first screen 24 or the second screen described above. In addition, the additional marker screens can have different lengths and/or widths than the first marker screen 24 and each other.

The marker screen assembly 20 can include additional rolling mechanisms so that each of the additional screens can be independently extended from or retracted within the housing 22. The configuration of the housing 22 can vary accordingly.

It should be understood that the marker screen assembly 20 of FIGS. 1-13 is just one possible size of the marker screen assembly 20. In other embodiments, the marker screen assembly 20 can be made in any suitable size. For example, smaller versions of the marker screen assembly 20 can be sized to fit within purse, backpacks, binders, etc. Larger versions of the marker screen assembly 20 can be made for larger classrooms, conference rooms, offices, etc.

Figure 11:
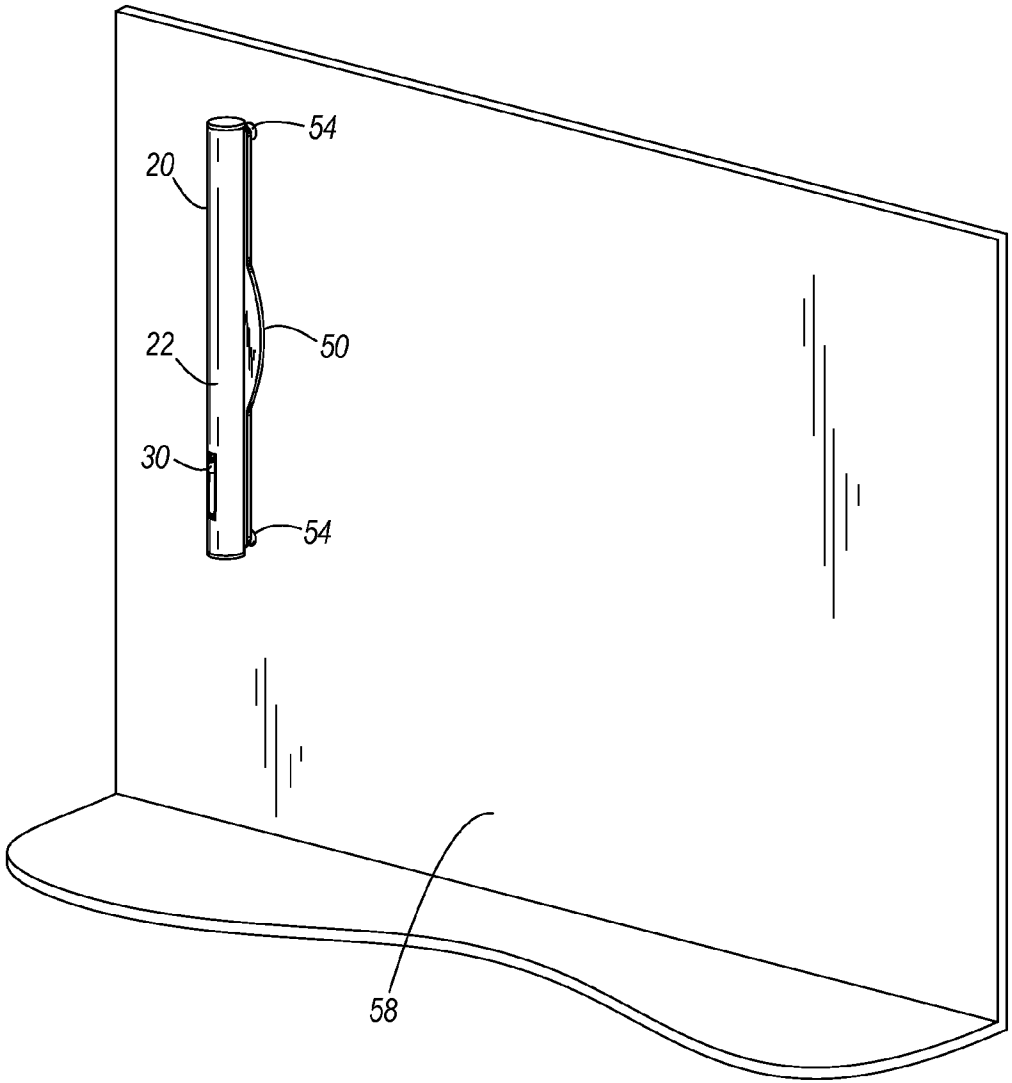
FIG. 11 is a perspective view showing one application of the erasable marker screen assembly of FIG. 1 with the marker screen retracted within the housing.
Figure 12:
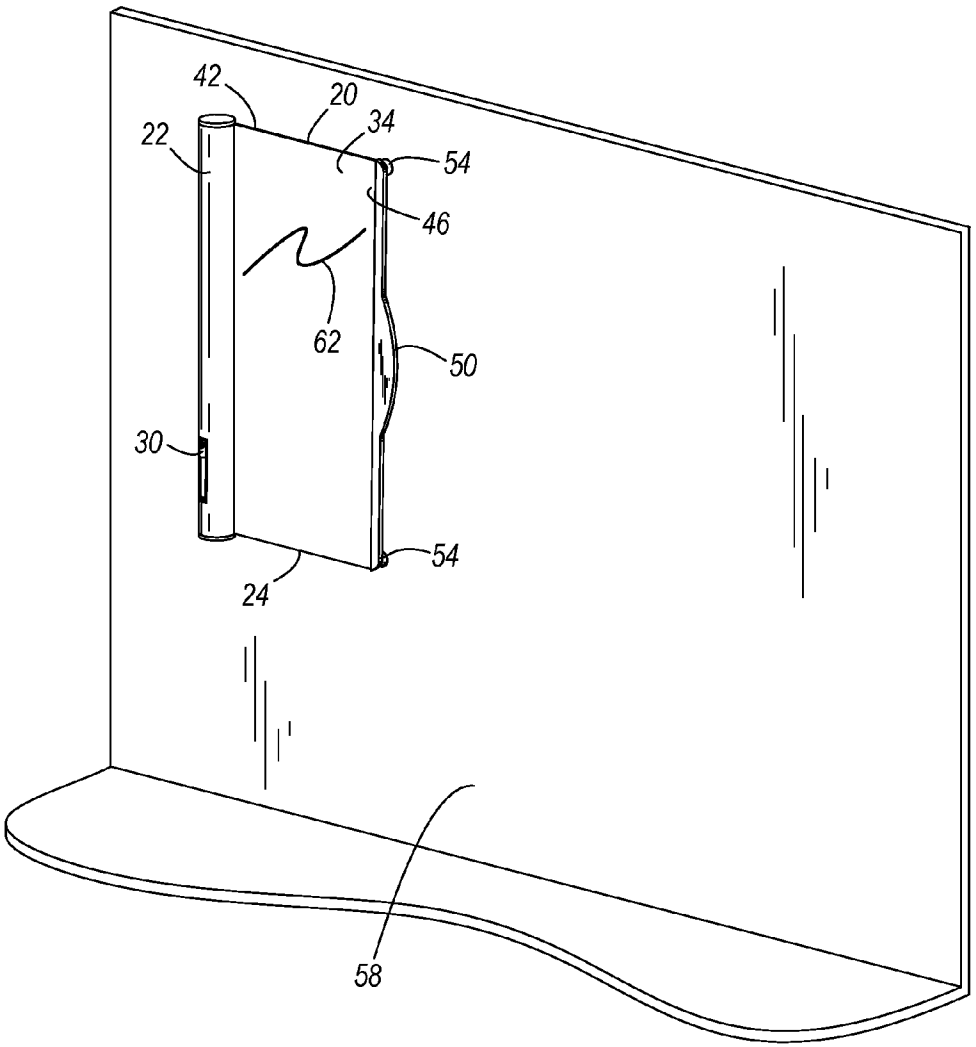
FIG. 12 is a perspective view of the marker screen assembly of FIG. 11 showing the screen extended a first length from the housing.
Figure 13:
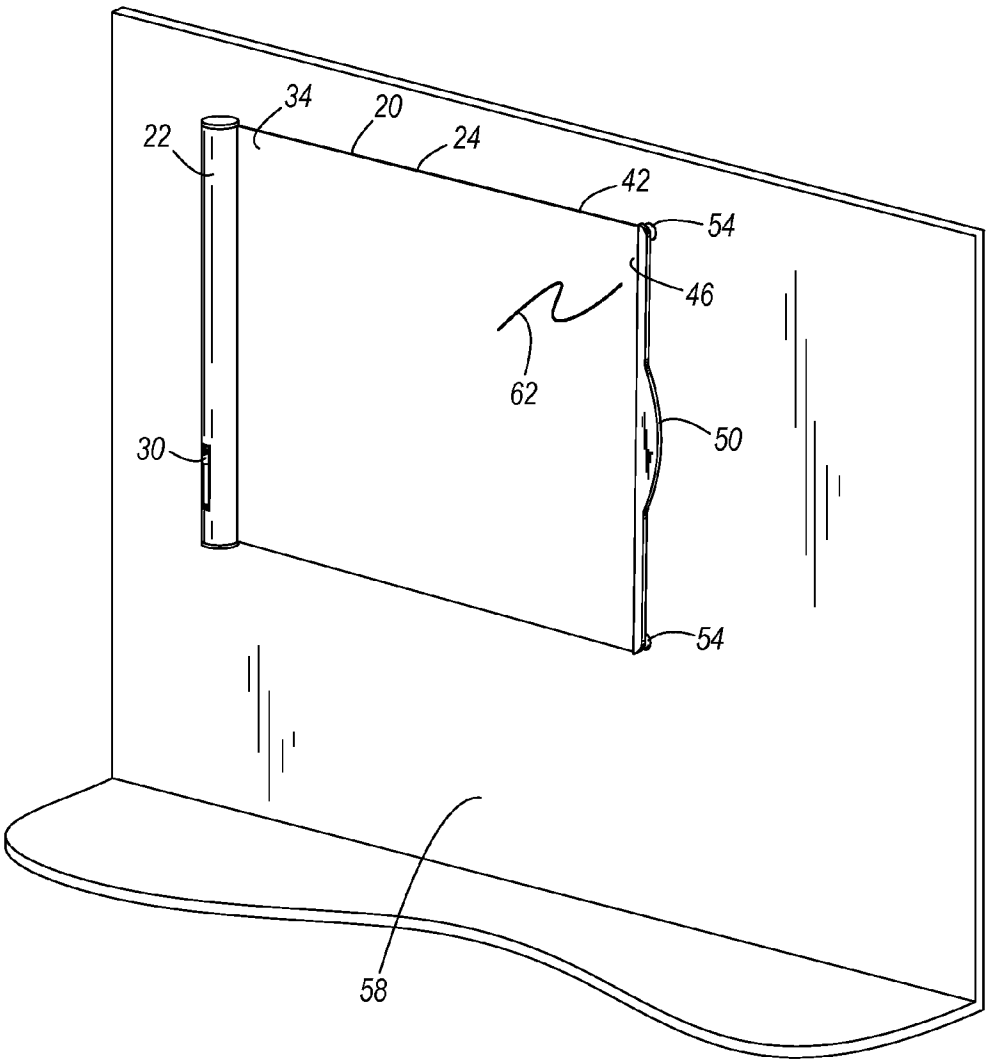
FIG. 13 is a perspective view of the marker screen assembly of FIG. 11 showing the screen extended a second length from the housing.

Referring to FIGS. 11 and 12, in operation, the user couples the marker screen assembly 20 to a surface 58 using the coupling members 32 of the housing 22. The user grabs the handle 50 of the marker screen 24, which is biased into the retracted position (FIG. 11), and pulls the screen 24 to extend at least a portion of the screen 24 from the housing 22. As illustrated in FIGS. 12 and 13, the user can extend the screen 24 to any suitable length. The clutch of the rolling mechanism can hold the marker screen 24 in the extended position at any length desired by the user. If the support member 38 can be inflated or otherwise manipulated to add rigidity to the writing surface 34, the user can next take such action.

Then, the user utilizes the coupling members 54 of the marker screen 24 (FIG. 3) and handle 50 to couple the marker screen 24 to the surface 58.

While the illustrated screen 24 of the marker screen assembly 20 opens or extends from the user's left to right, in other embodiments the screen can extend in any direction with respect to the user. For example, the marker screen assembly 20 can be mounted such that the screen extends upwards, downwards, left to right, right to left, diagonally, etc.

With the screen 24 at least partially extended from the housing 22, the user can write on the writing surface 34, generally indicated by a line 62, using the marker 30. When the user has finished writing they can erase the writing or retract the screen back within the housing 22 (FIG. 11) prior to erasing the writing.

The user may desire to retract the screen 24 within the housing 22 without erasing the writing. For example, in some situations the user may not want to reveal or disclose information on the writing surface 34. Therefore, when desired, the user can retract the screen 24 within housing 22. Similarly, the user may want to leave the writing or information on the screen 24 so that the writing can be displayed again at a later time, possibly in a different location. As discussed above, the marker 30 that is only erasable using a wet eraser reduces smudging or smearing of the writing when the screen 24 is retracted within the housing 22.

As illustrated in FIG. 11, the user can retract the marker screen 24 to within the housing 22. Then, the user can decouple the marker screen assembly 20 from the surface 58 to allow the user to easily move the writing assembly 20 to a different location (i.e., another room, building, etc.). In some embodiments a locking mechanism can be included to lock the screen 24 inside the housing 22. Any suitable locking configurations (e.g., key locks, combination locks, push button locks, etc.) can be used.

Figure 16:
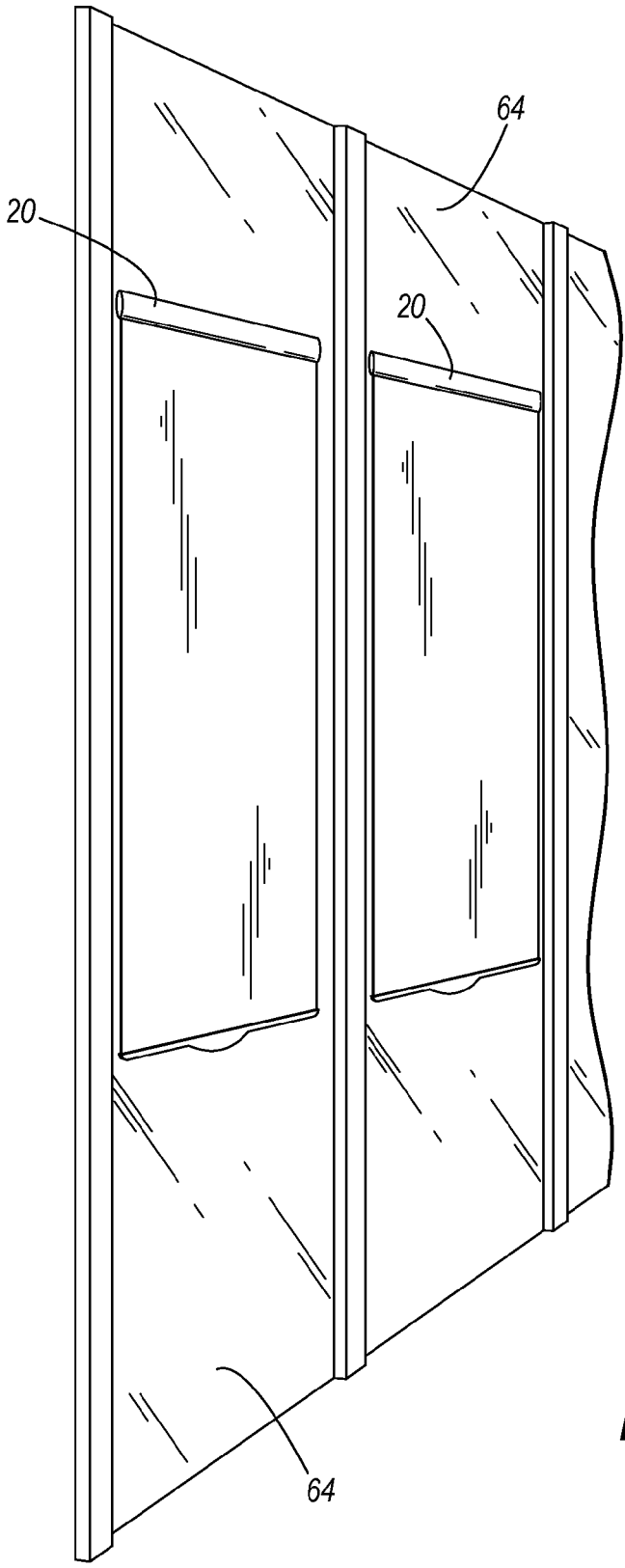
FIGS. 16-17 illustrate one application of the marker screen assembly of FIGS. 1 and 14.
Figure 17:
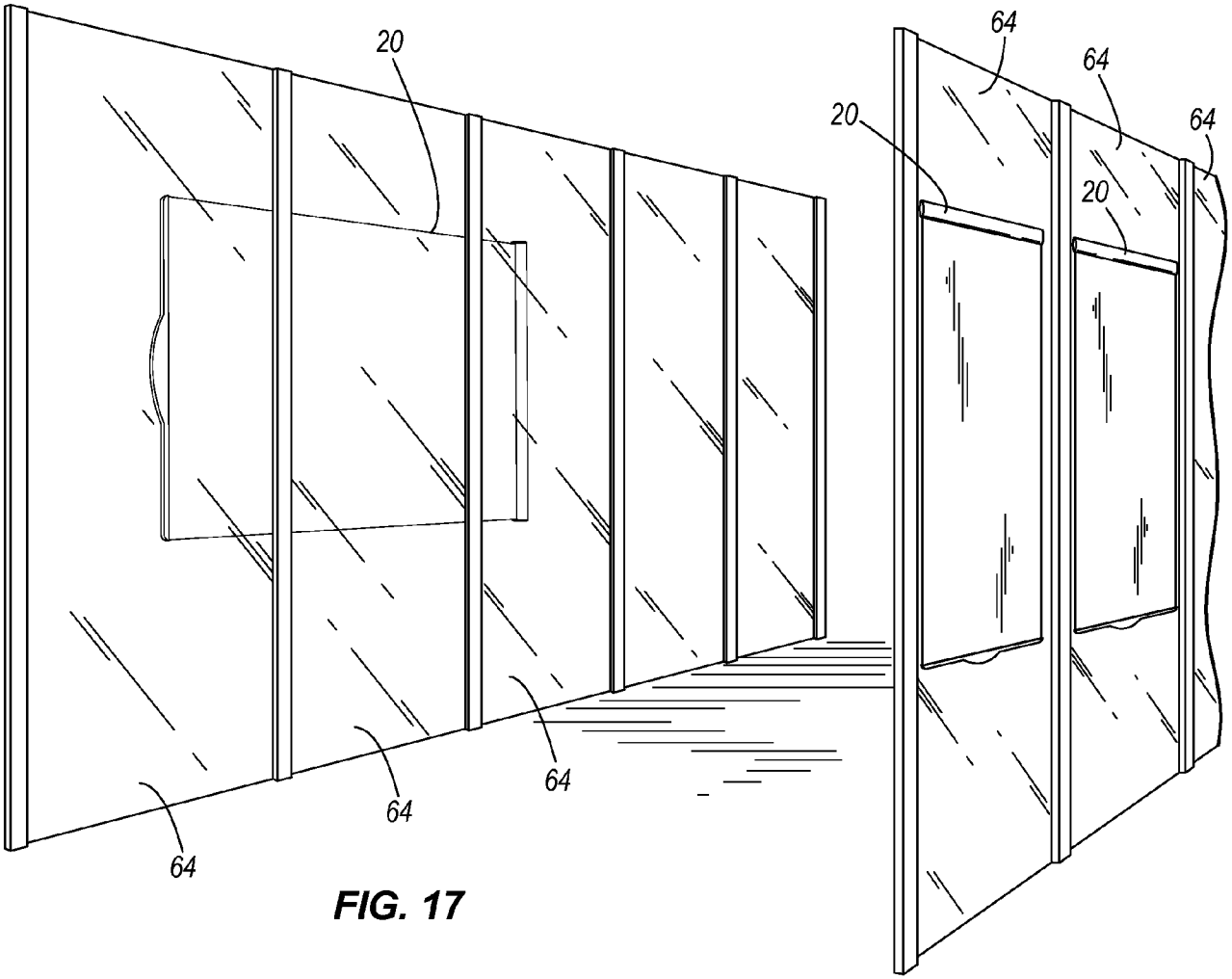

FIGS. 16 and 17 illustrate possible applications of the erasable marker screen assembly 20. In the illustrated applications, the marker screen assemblies 20 are coupled to glass walls 64. Glass walls, similar to the glass walls 64 of FIGS. 16 and 17, have become more common in office buildings. Generally, it can be difficult or unsightly to mount standard dry erase marker boards to a glass wall. However, the marker screen assembly 20 provides a convenient solution for attaching a marker screen or board to a glass wall. Furthermore, the marker screen assemblies 20 can be easily removed from the glass walls 64.

While operation of the marker screen assembly 20 was described with reference to a single marker screen assembly, it should be understood that multiple marker screen assemblies can be utilized. For example, the user can arrange two marker screen assemblies 20 such that both screens extend to couple the handles 50 together to hold the marker screens in the extended or open position. Of course, other configuration of multiple marker screen assemblies can also be utilized.

Figure 14:
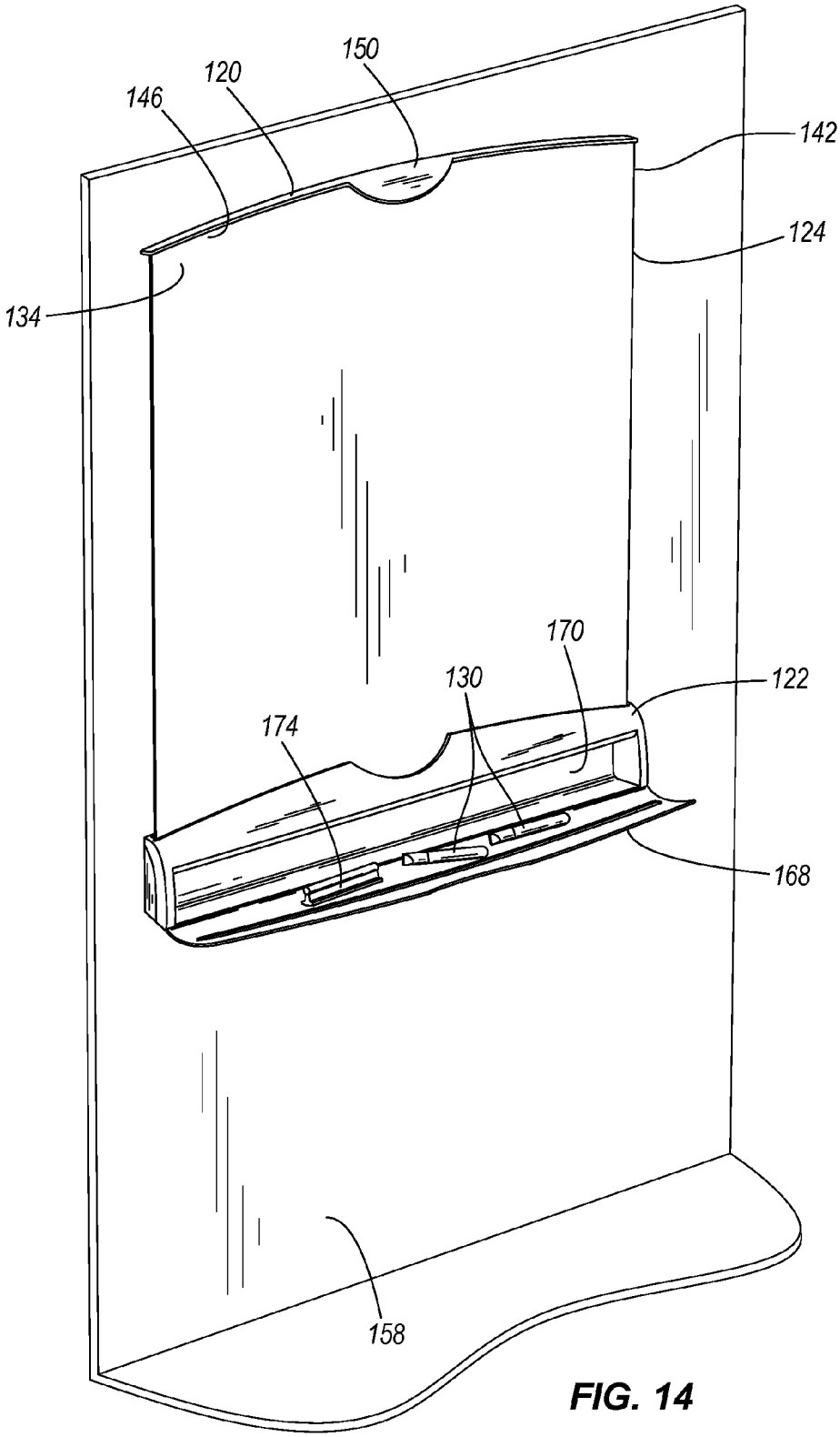
FIG. 14 is front perspective view of an alternative construction of a marker screen assembly showing the marker screen extended from the housing.

FIG. 14 illustrates an alternative construction of the erasable marker screen assembly 20 of FIGS. 1-13. The erasable marker screen assembly 120 of FIGS. 14-15*d* is generally the same as the writing assembly 20. Therefore, like components have been given like reference numbers plus one hundred, and only the general differences between the erasable marker screen assemblies 20 and 120 will be discussed below.

With continued reference to FIG. 14, the erasable marker screen assembly 120 includes the housing 122. The housing 122 includes a door 168 that grants access to an integral storage compartment 170. The storage compartment 170 can be used to store a stand for the marker screen assembly 120, erasers 174, markers 130, pens, other office supplies, and the like.

In operation, the user can open the door 168 of the housing 122 and use an inner surface of the door 168 as a tray to conveniently support markers 130, erasers 174, pens, other office supplies and the like.

Figure 15A:
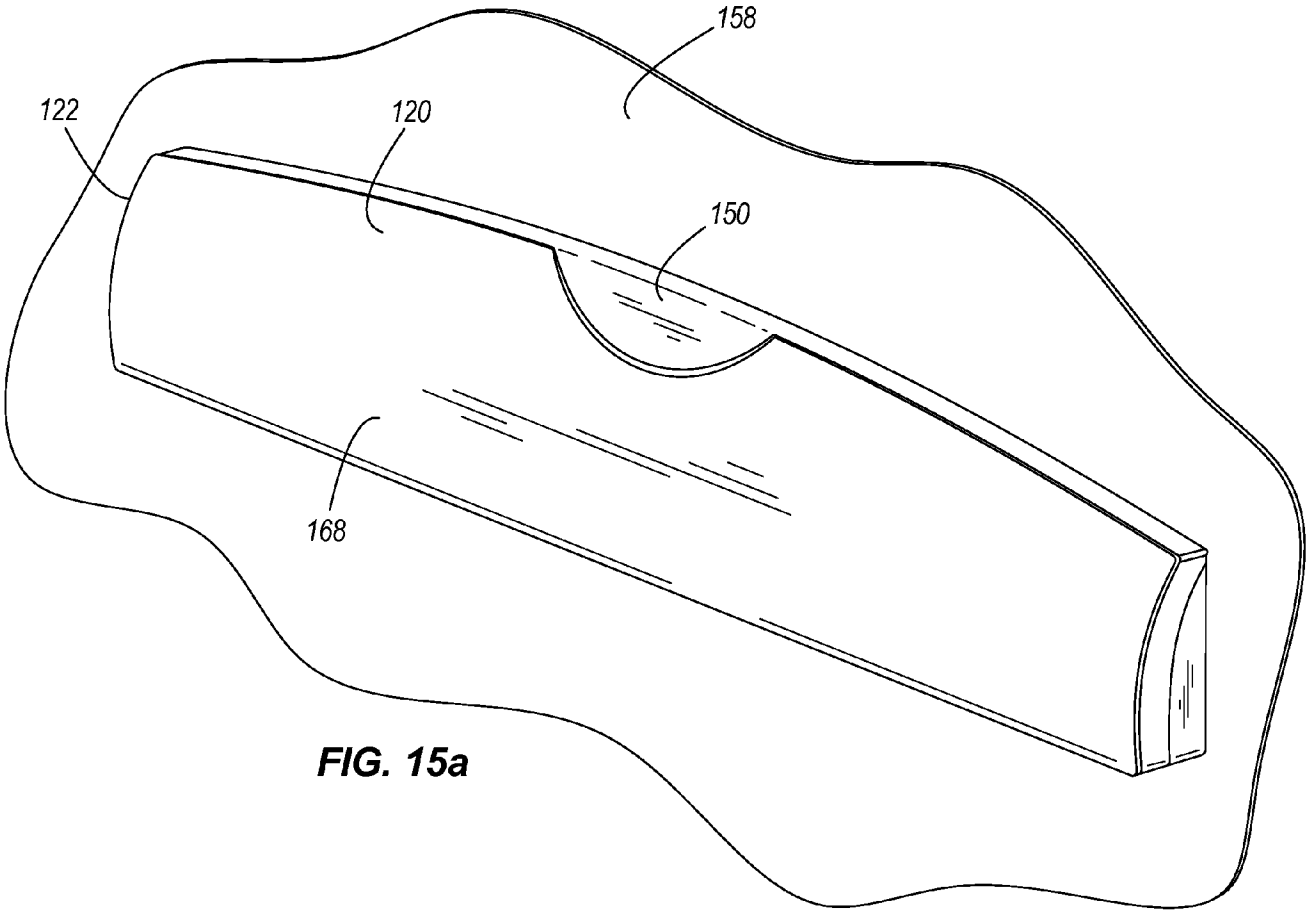
FIGS. 15*a*-15*d* show various embodiments of the marker screen assembly of FIG. 14 with the marker screen retracted within the housing.
Figure 15B:
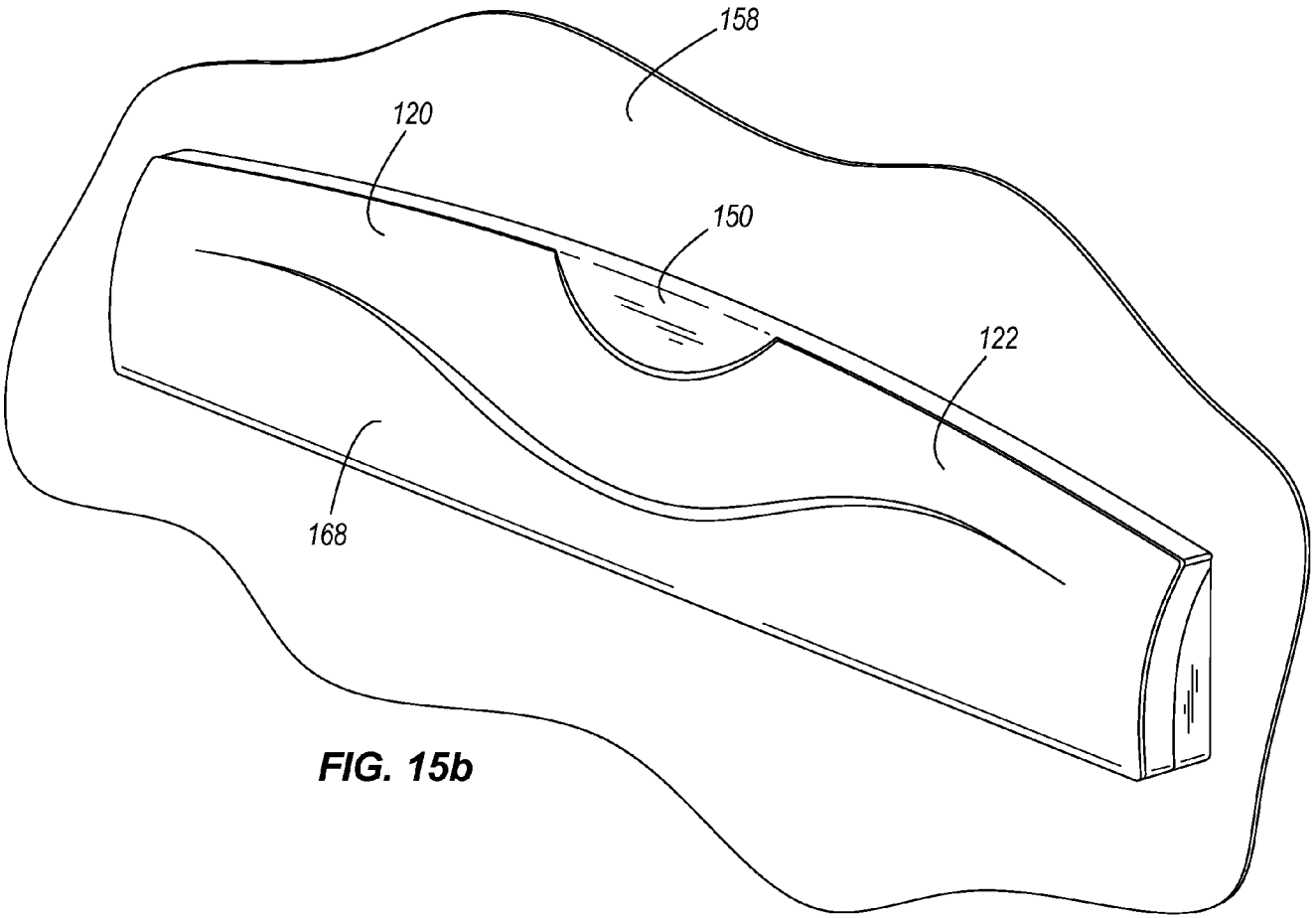
Figure 15C:
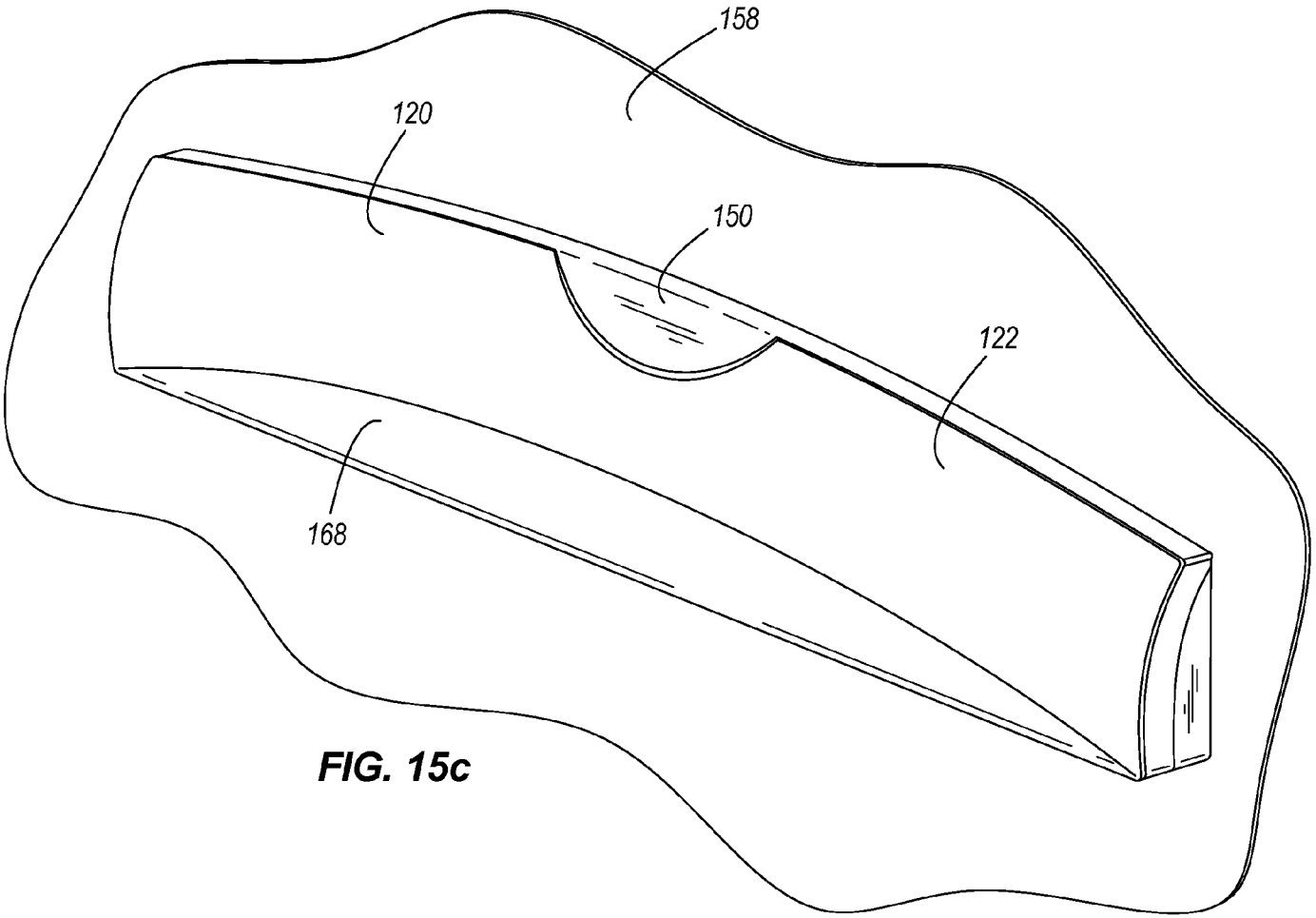
Figure 15D:
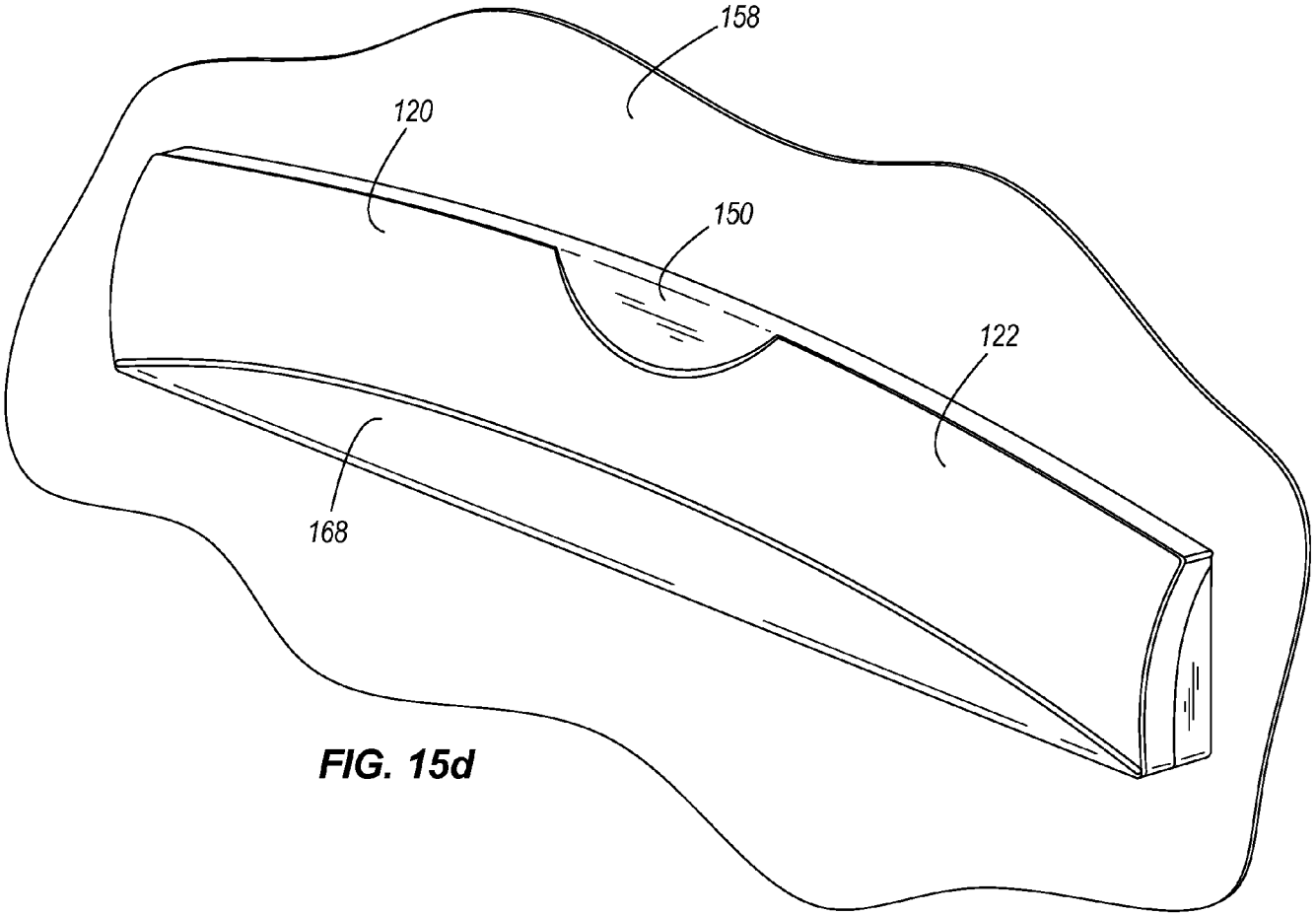

Referring to FIG. 15*a*, the user can close the door 168 to enclose the storage compartment 170. While FIG. 15*a* illustrates the door 168 in the closed position when the marker screen 124 is in the retracted positions, the door 168 can also be closed when the marker screen 124 is in the extended position. FIGS. 15*a*-15*d* illustrate various embodiments of an outer surface of the door 168 and the housing 122.

FIGS. 18-21 illustrate yet another alternative construction of the erasable marker screen assembly 20 of FIGS. 1-13. The erasable marker screen assembly 220 of FIGS. 18-21 is generally the same as the writing assembly 20. Therefore, like components have been given like reference numbers plus two hundred, and only the general differences between the erasable marker screen assembly 220 and the erasable marker screen assemblies 20 and 120 will be discussed below.

Figure 18:
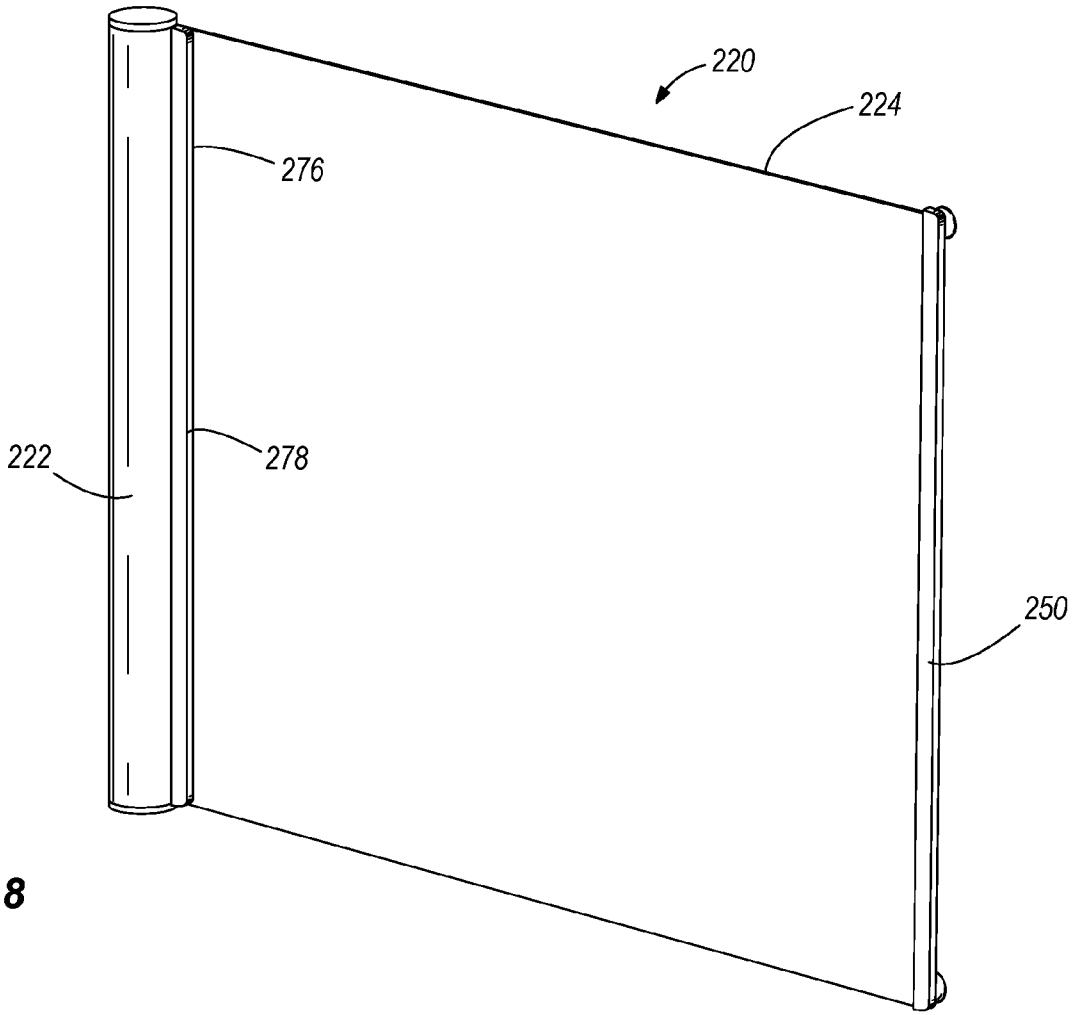
FIGS. 18-21 illustrate yet another alternative construction of a marker screen assembly.

FIG. 18 illustrates the marker screen assembly 220 that includes the first screen 224 and a second screen 276 that can overlay or cover the first screen 224. The illustrated second screen 276 includes a handle 278 that is generally the same as the handle 250 of the first screen 224.

Figure 19:
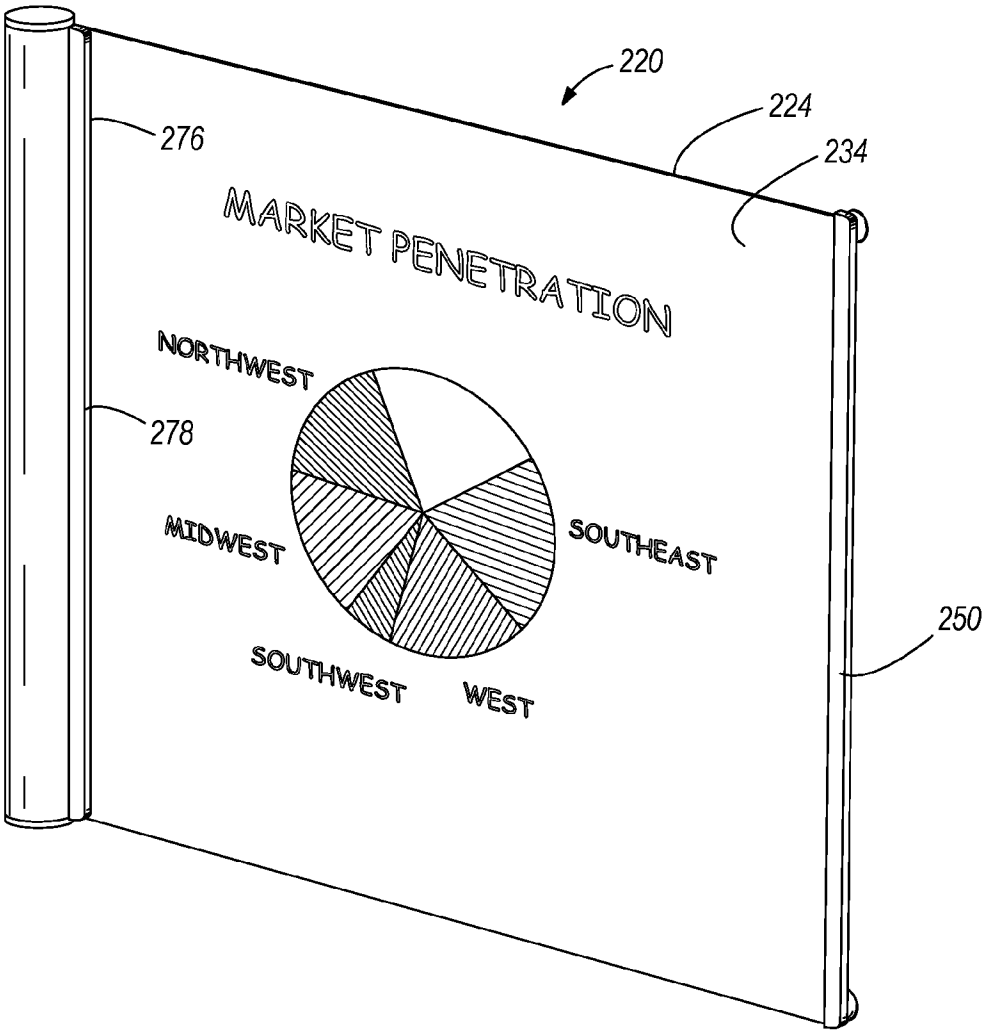
Figure 20:
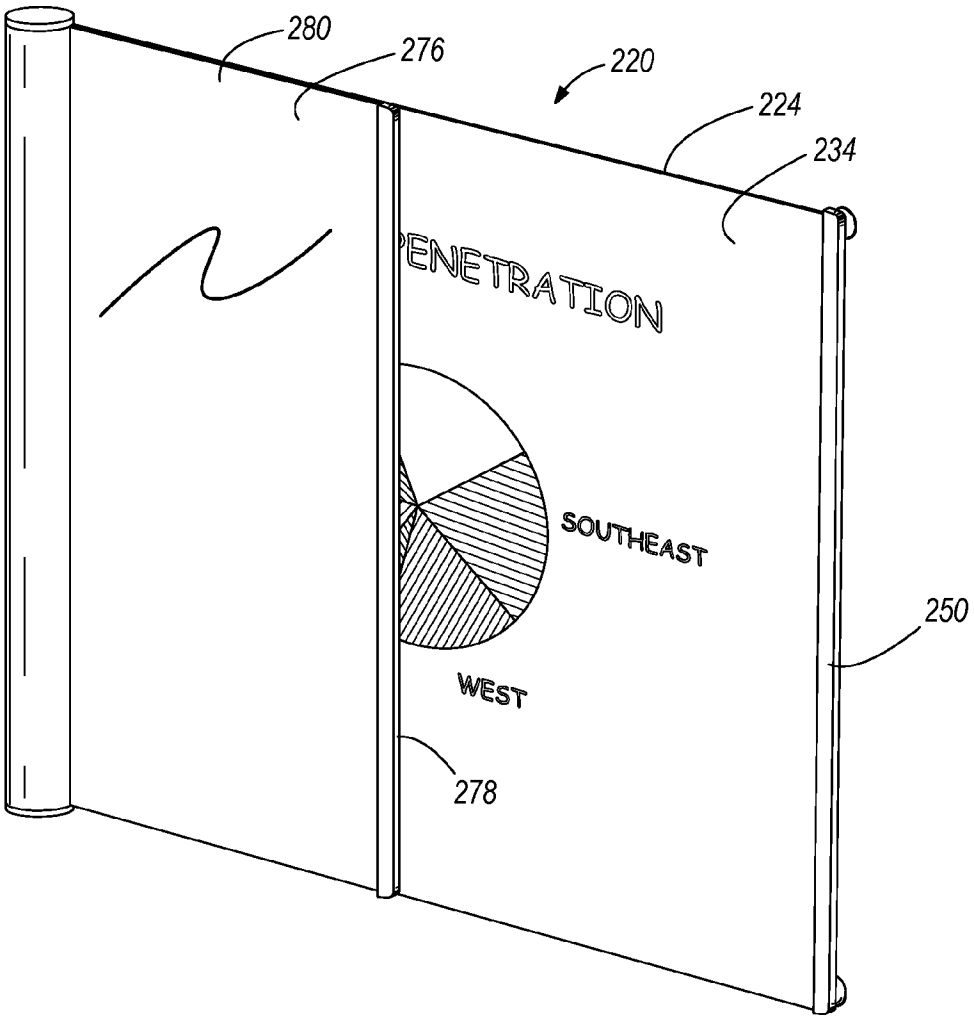
Figure 21:
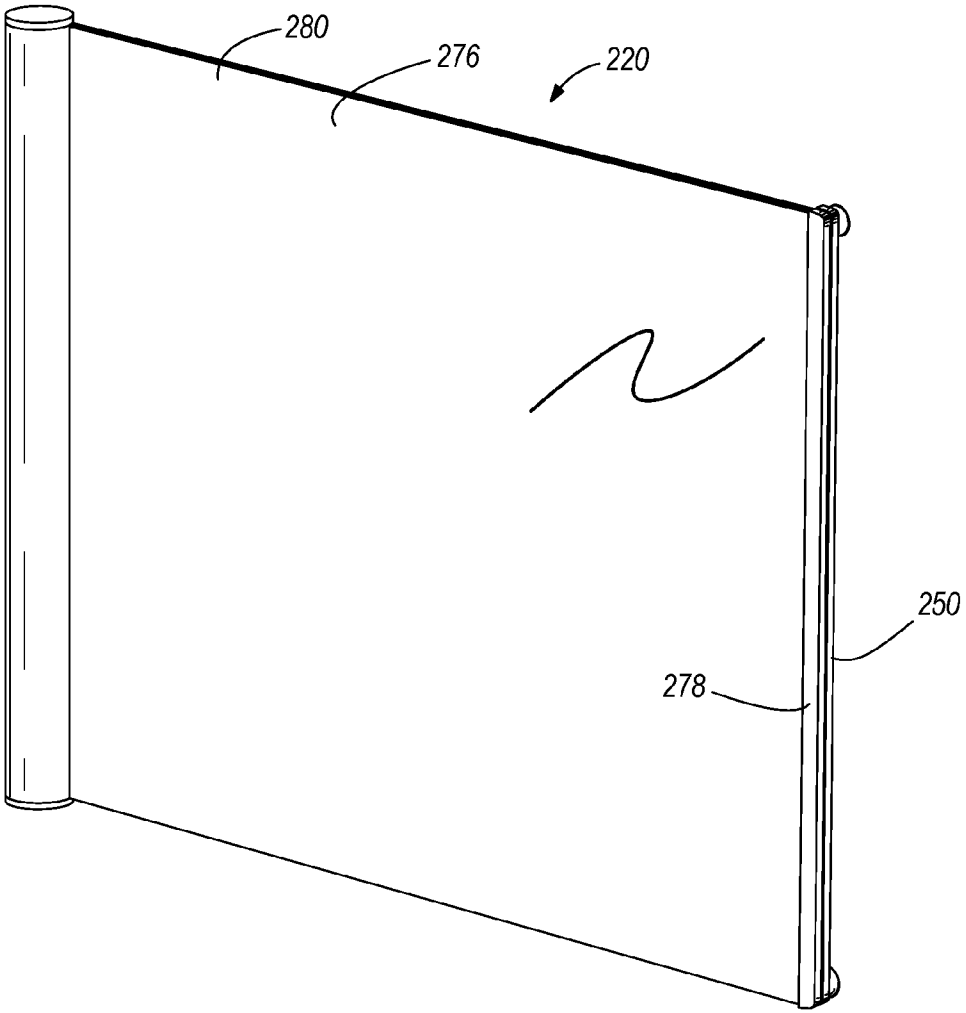

Referring to FIG. 19, writing, graphs, images, and the like can be placed on the writing surface 234 of the first screen 224. Referring to FIG. 20, the user can pull the second screen 276 across a portion of the first screen 224 to overlay or cover the first screen 224. As illustrated in FIG. 20, the second screen 276 can be extended to only partially cover the first screen 224, or, as illustrated in FIG. 21, the second screen 276 is extendable to fully cover the first screen 224. Furthermore, the second screen 276 includes a writing surface 280 that is generally identical to the writing surface 234 of the first screen 224. In other constructions, the writing surface 280 of the second screen 276 can be generally translucent or transparent such that images on first screen 224 are visible through the second screen 276. In such constructions, the user can write on the writing surface 280 of the second screen 276 to highlight or overlay images on the first screen 224.

FIGS. 22-26 illustrate yet another alternative construction of the erasable marker screen assembly 20 of FIGS. 1-13. The erasable marker screen assembly 320 of FIGS. 22-26 is generally the same as the writing assembly 20. Therefore, like components have been given like reference numbers plus three hundred, and only the general differences between the erasable marker screen assembly 320 and the erasable marker screen assemblies 20, 120, and 220 will be discussed below.

Figure 22:
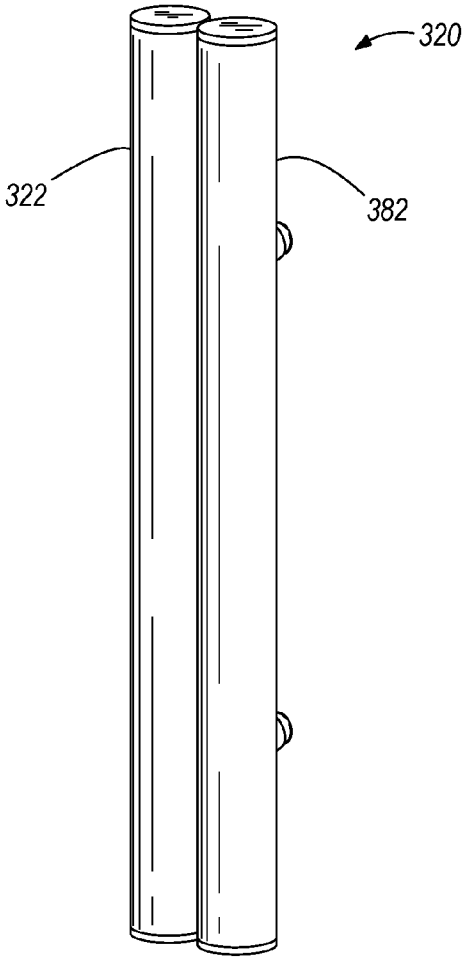
FIGS. 22-26 illustrate yet another alternative construction of a marker screen assembly.
Figure 23:
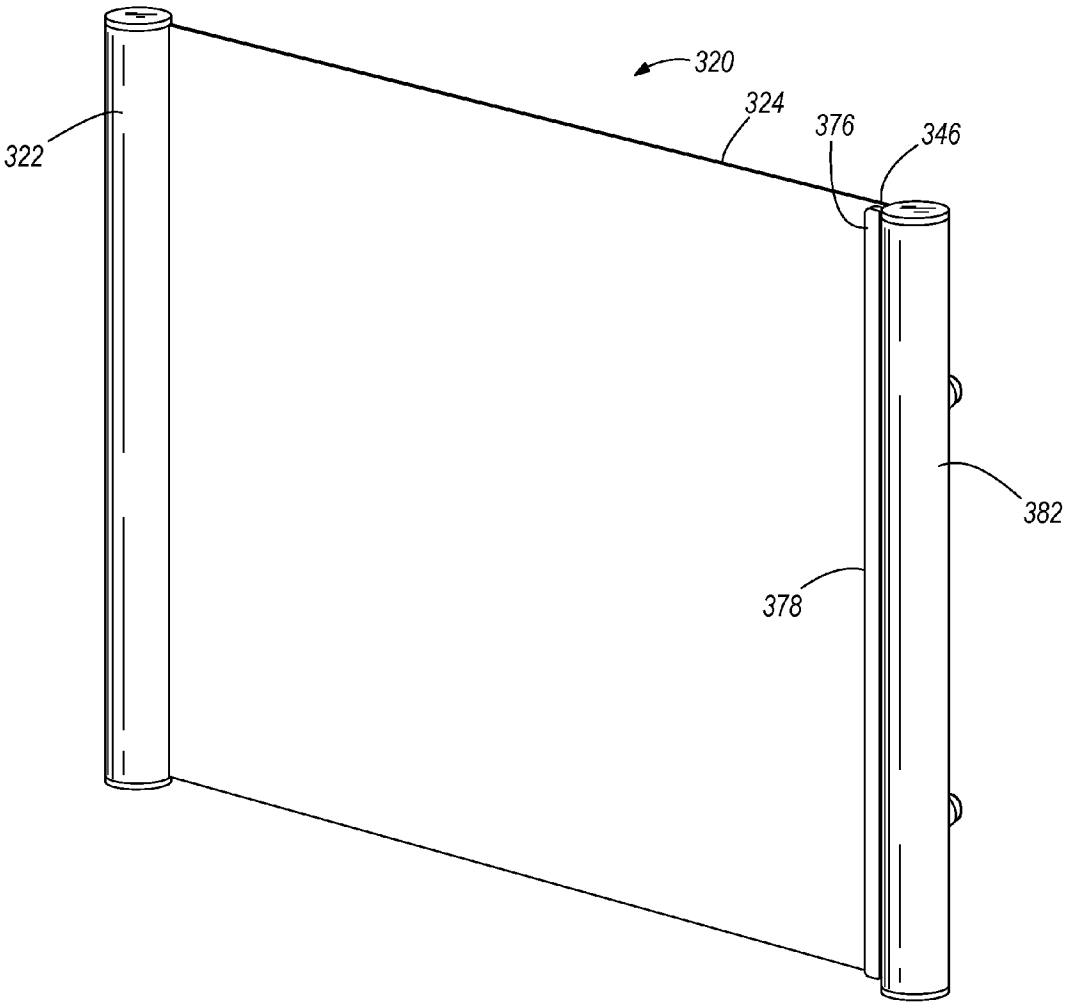

Referring to FIGS. 22 and 23, the erasable marker screen assembly 320 includes the housing 322, which is a first housing, and a second housing 382. In one construction, the rolling mechanism that rolls the first screen 324 is within the first housing 322. The second housing 382 is coupled to the first end portion 346 of the first screen 324, and a rolling mechanism that rolls the second screen 376 is located within the second housing 382. In alternative constructions, rolling mechanisms are located in both the first and second housings 322, 382 to roll the first screen 324. Therefore, approximately half of the first screen 324 retracts into the first housing 322 while the other half retracts into the second housing 382.

Figure 24:
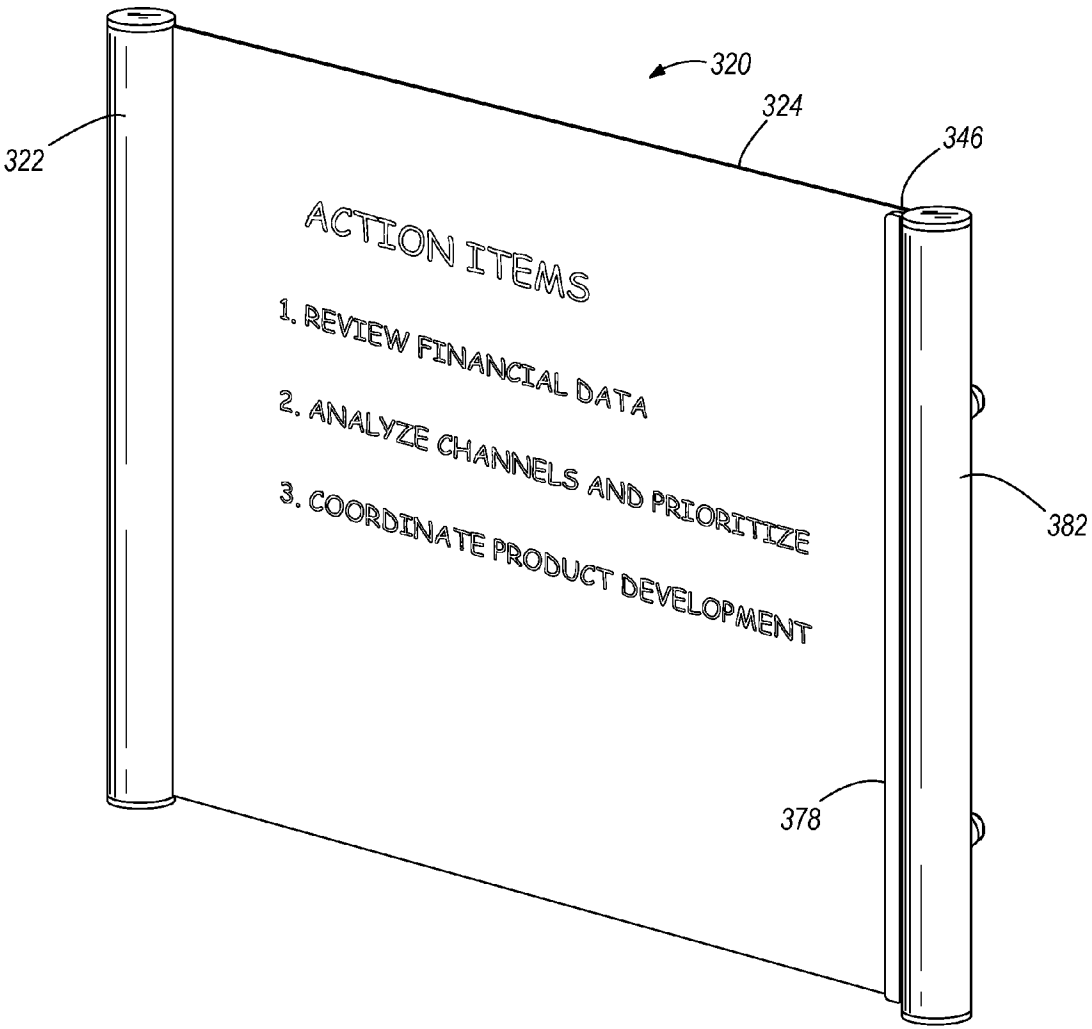
Figure 25:
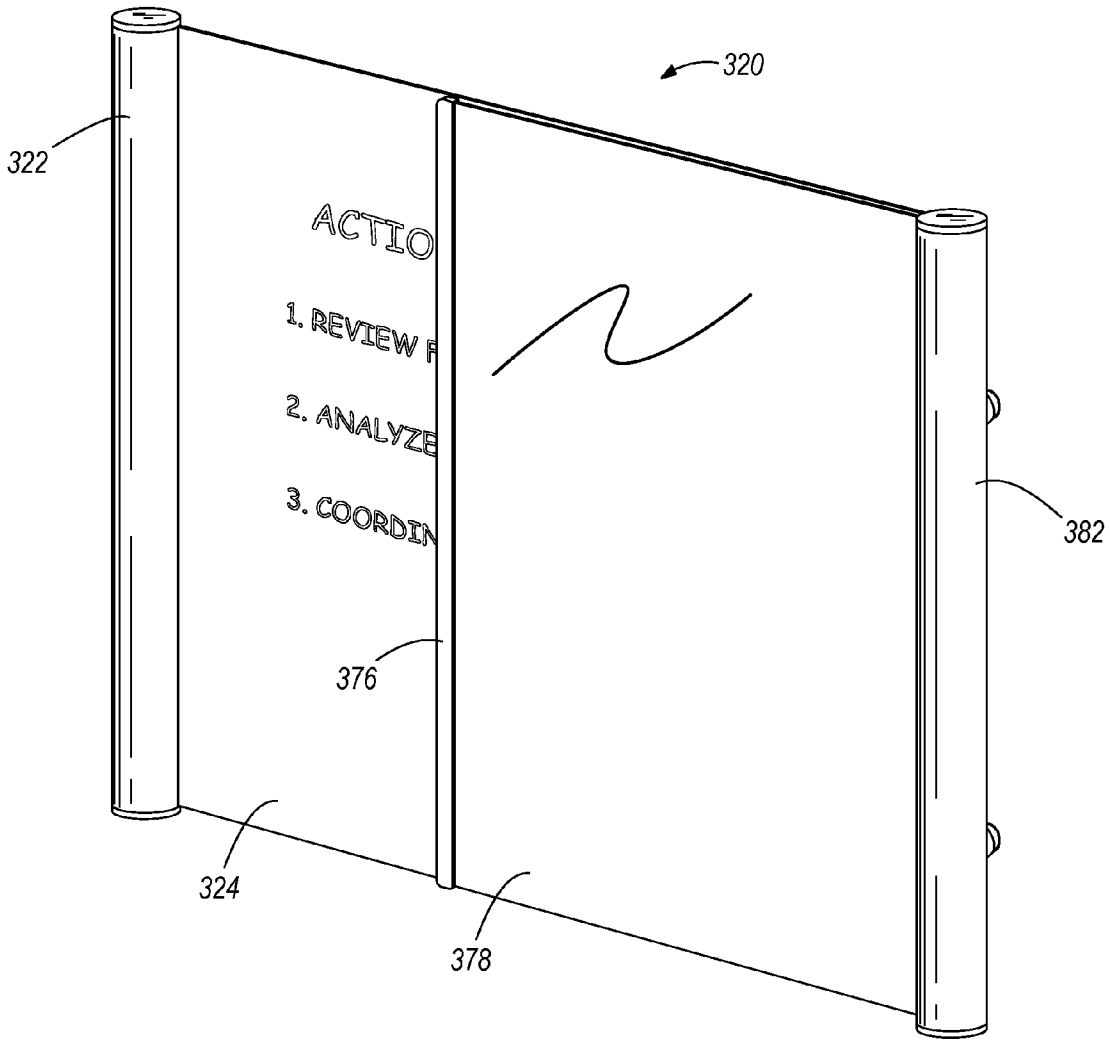
Figure 26:
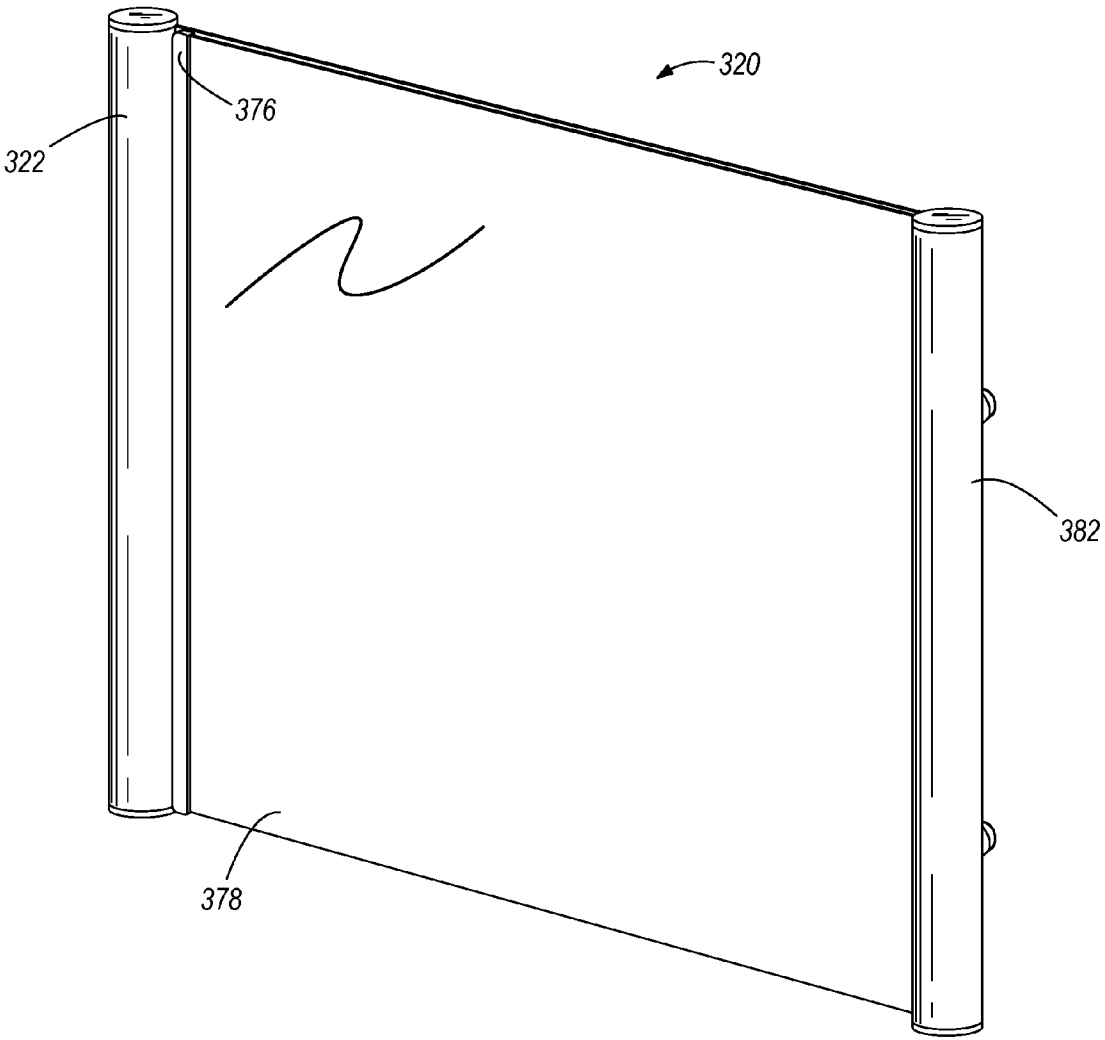

Referring to FIG. 23, in operation, the user separates or pulls apart the first and second housings 322, 382 to extend or open the first screen 324. Referring to FIGS. 24-26, the user can then operate the second screen 376 as described above with regard to FIGS. 1-13 and 18-21.

FIGS. 27-29 illustrate yet another alternative construction of the erasable marker screen assembly 20 of FIGS. 1-13. The erasable marker screen assembly 420 of FIGS. 27-29 is generally the same as the writing assembly 320. Therefore, like components have been given like reference numbers plus 100, and only the general differences between the erasable marker screen assembly 420 and the erasable marker screen assemblies 20, 120, 220, and 320 will be discussed below.

Referring to FIGS. 27-29, the erasable marker screen assembly 420 includes the first housing 422, the first screen 424 partially received within the first housing 422, and the second housing 482 coupled to the first end 446 of the first screen 424. In the illustrated construction, the second screen 478 is a translucent or transparent screen. The translucent second screen 478 allows writing or images on the first screen 424 to remain visible through the second screen 478, while also allowing a user to add additional writing or images on the second screen 478 without disturbing or altering the writing or images on the first screen 424.

Figure 30:
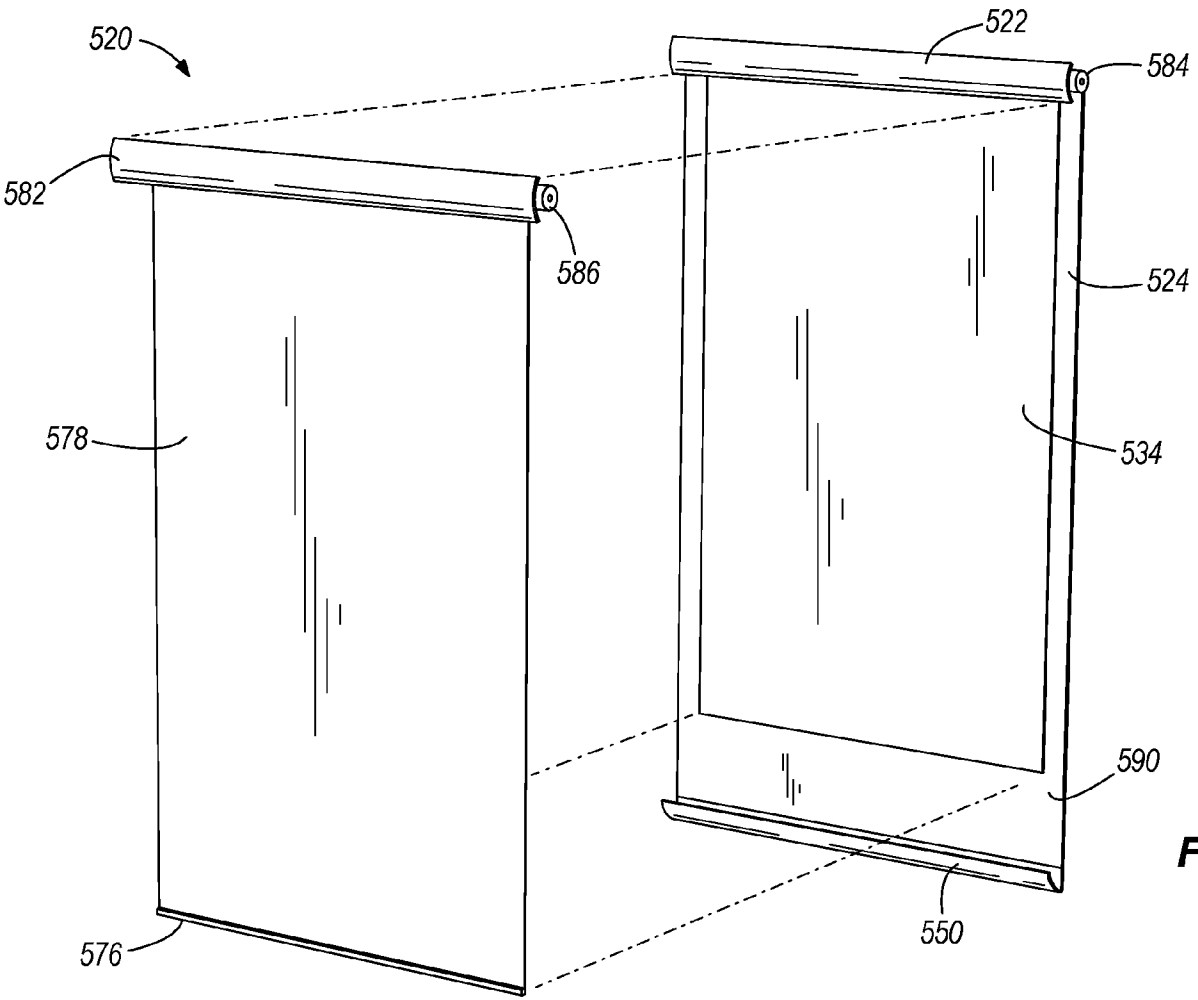
FIG. 30 is an exploded view of yet another alternative construction of a marker screen assembly.
Figure 31A:
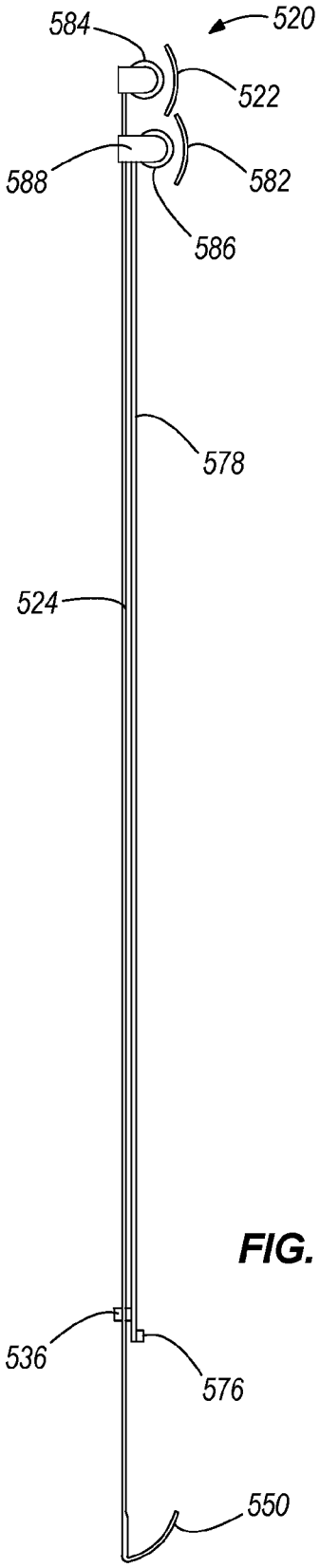
FIG. 31*a* is a side view of the marker screen assembly of FIG. 30 showing marker screens extended from housings.
Figure 31B:
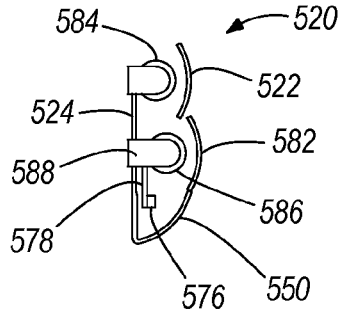
FIG. 31*b* is a side view of the marker screen assembly of FIG. 30 showing the marker screens retracted within the housings.
Figure 31C:
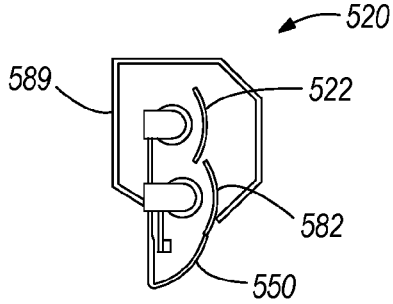
FIG. 31*c* is a side view of the marker screen assembly of FIG. 31*b*, where the marker screen assembly includes a shroud.

FIGS. 30-31*b* illustrate yet another alternative construction of the erasable marker screen assembly 20 of FIGS. 1-13. The erasable marker screen assembly 520 of FIGS. 30-31*b* is generally the same as the writing assembly 20. Therefore, like components have been given like reference numbers plus 500, and only the general differences between the erasable marker screen assembly 520 and the erasable marker screen assemblies 20, 120, 220, 320, and 420 will be discussed below.

Referring to FIG. 30, the erasable marker screen assembly 520 includes the first screen 524 coupled to a first rolling mechanism 584 of the first housing 522 and the second screen 578 coupled to a second rolling mechanism 586 of the second housing 582. In the illustrated construction, the second screen 578 is opaque, but in other constructions the second screen 578 may be translucent or transparent. The second housing 582 couples to the first screen 524 adjacent to the first housing 522 with brackets 588 (FIGS. 31*a* and 31*b*), although other suitable coupling elements may be used. In some constructions, such as the construction shown in FIG. 31*c*, a shroud 589 or other suitable structure may at least partially surround, interconnect, or unitize the first and second housings 522, 582 to provide an ornamental or aesthetic cover (i.e., a single housing) and/or to render the marker screen assembly 520 a modular or unitized assembly.

As shown in FIG. 30, the first screen 524 includes the handle 550 and a border 590. The handle 550 is coupled to an opposite end of the first screen 524 than the first housing 522 and is configured to hold markers, erasers, office supplies, or the like.

The border 590 may be, for example, a printed border of a solid color or the border may include a decorative design. The border 590 delineates the edge of the writing surface 534 to help a user identify where the writing surface 534 ends and where the surrounding surface (e.g., the wall) begins.

Referring to FIGS. 31A and 31B, the first and second screens 524, 578 are movable between an extended position (FIG. 31A) and a retracted position (FIG. 31B). The first screen 524 is movable to the extended position while the second screen 578 is retracted such that a user may write and/or draw on the first screen 524. The second screen 578 may then be moved to the extended position to overlay at least a portion of the first screen 524 such that a user may continue to write and/or draw over or on top of the first screen 524. In the illustrated construction, the handle 550 of the first screen 524 inhibits the second screen 578 from moving to the extended position when the first screen 524 is in the retracted position. However, in other constructions, the handle 550 may be configured to allow the second screen 578 to move to the extended position when the first screen 524 is in the retracted position. When the user is finished writing, the user may move the first and second screens 524, 578 to the retracted position to hide the writing on the screens 524, 578 or to make the marker screen assembly 520 more suitable for transport.

The above discussion and the accompanying figures describe various features and embodiments of the invention. However, those skilled in the art will understand that numerous other combinations and modifications of the above features and embodiments can be made while still falling within the scope of the invention.

Various features of the invention are set forth in the following claims.

The invention claimed is:

1. A marker screen assembly comprising:

a first housing;

a first screen stored within the first housing and movable to an extended position;

a second housing adjacent to the first screen; and a second marker screen stored within the second housing and movable to an extended position, the second marker screen having a writing surface designed to be repeatably written upon and erased and configured to overlay at least a portion of the first screen when both the first and second screens are in the extended position.

2. The marker screen assembly of claim 1, wherein the first screen is a first marker screen having a writing surface designed to be repeatably written upon and erased.

3. The marker screen assembly of claim 1, wherein the second marker screen is translucent.

4. The marker screen assembly of claim 1, wherein the second marker screen is opaque.

5. The marker screen assembly of claim 1, wherein the first screen includes a first end portion extendable from the first housing and a second end portion stored within the first housing, and wherein the second housing is coupled to the first end portion.

6. The marker screen assembly of claim 1, wherein the second housing is coupled to the first screen adjacent to the first housing.

7. The marker screen assembly of claim 1, wherein the first housing includes a coupling member configured to removably couple the first housing to a surface.

8. The marker screen assembly of claim 1, wherein the second marker screen includes an attachment member configured to couple the second marker screen to the first screen when both of the first and second screens are in the extended position.

9. A portable marker screen assembly comprising:

a housing sized and configured to be carried by a user, the housing including a storage compartment and a door movable between a closed position and an open position to allow access to the storage compartment;

a coupling member connected to the housing and configured to removably couple the housing to a surface, an inner surface of the door being configured and oriented to operate as a support tray when the door is in the open position and the housing is removably coupled to the surface; and a marker screen stored within the housing and movable to an extended position, the marker screen having a writing surface designed to be repeatably written upon and erased.

10. The portable marker screen assembly of claim 9, wherein the coupling member includes a suction cup.

11. The portable maker screen assembly of claim 9, wherein the coupling member couples the housing to the surface without a permanent alteration of the surface.

12. The portable marker screen assembly of claim 9, further comprising a carrying member coupled to the housing to facilitate carrying the portable marker screen assembly.

13. The portable marker screen assembly of claim 9, further comprising a coupling member connected to an end of the marker screen and configured to removably couple the marker screen to the surface to maintain the marker screen in the extended position.

14. The portable marker screen assembly of claim 13, wherein the coupling member connected to the end of the marker screen is a suction cup.

* * * * *